US010517781B2

(12) United States Patent
Golden, Jr.

(10) Patent No.: US 10,517,781 B2
(45) Date of Patent: Dec. 31, 2019

(54) RECONFIGURATION MEANS FOR A WHEELCHAIR

(71) Applicant: Stephen C. Golden, Jr., Menasha, WI (US)

(72) Inventor: Stephen C. Golden, Jr., Menasha, WI (US)

( * ) Notice: Subject to any disclaimer, the term of this patent is extended or adjusted under 35 U.S.C. 154(b) by 66 days.

(21) Appl. No.: 15/619,528

(22) Filed: Jun. 11, 2017

(65) Prior Publication Data

US 2017/0273838 A1 Sep. 28, 2017

Related U.S. Application Data

(63) Continuation of application No. 14/952,810, filed on Nov. 25, 2015, now Pat. No. 9,700,469.

(51) Int. Cl.

| | |
|---|---|
| ***A61G 5/06*** | (2006.01) |
| ***A61G 5/10*** | (2006.01) |
| *A61G 5/02* | (2006.01) |

(52) U.S. Cl.

CPC ..... *A61G 5/06* (2013.01); *A61G 5/104* (2013.01); *A61G 5/1083* (2016.11); *A61G 5/1089* (2016.11); *A61G 5/02* (2013.01)

(58) Field of Classification Search

CPC ..... A61G 5/068; A61G 5/06

See application file for complete search history.

(56) References Cited

U.S. PATENT DOCUMENTS

| | | | |
|---|---|---|---|
| 3,137,276 | A | 6/1964 | Weisser |
| 3,170,362 | A | 2/1965 | Mewse |

(Continued)

FOREIGN PATENT DOCUMENTS

| | | | |
|---|---|---|---|
| DE | 4107410 | C2 | 3/1990 |
| FR | 2841462 | A1 | 1/2004 |

(Continued)

OTHER PUBLICATIONS

Requirement for Restriction/Election for U.S. Appl. No. 14/314,030, dated Nov. 10, 2015.

(Continued)

*Primary Examiner* — Kevin Hurley

(57) ABSTRACT

Means for reconfiguring a wheelchair are disclosed wherein a user or an occupant of the wheelchair is enabled to repeatably alternate the wheelchair between an original load-bearing configuration and a modified load-bearing configuration by engaging and disengaging a ground-contacting adaptive implement operatively connected to a load transitioning mechanism, said load transitioning mechanism adapted for connection to a forward portion of the wheelchair. Embodiments according to the present invention enable an occupant of the wheelchair to alternate the wheelchair, through a cyclic operation sequence, between the original configuration and the modified configuration by toggling of a manipulable switch and subsequent momentary reclining of the wheelchair. The user willfully effectuates a change in the angular disposition of the ground-contacting adaptive implement relative to the wheelchair about a substantially horizontal joint axis wherein in the modified configuration a deployed angular orientation is maintained under load-bearing conditions during travel of the wheelchair in all directions. Embodiments of the present invention enable wheelchair reconfiguration with simplicity of operation while ensuring rigid attachment of a ground-contacting adaptive implement to the wheelchair to confer special functionalities to the wheelchair while preserving comfort and safety for the user while the wheelchair is in the modified load-bearing configuration.

19 Claims, 17 Drawing Sheets

(56) References Cited

U.S. PATENT DOCUMENTS

| | | | | |
|---|---|---|---|---|
| 3,192,820 | A | 7/1965 | Pitzer | |
| 3,318,289 | A | 5/1967 | Marynissen | |
| 4,132,423 | A * | 1/1979 | Chant | A61G 5/06 280/5.3 |
| 4,316,616 | A | 2/1982 | Boivin | |
| 4,511,157 | A | 4/1985 | Wilt, Jr. | |
| 5,273,304 | A | 12/1993 | Berkheimer | |
| 5,280,937 | A | 1/1994 | Needham | |
| 6,311,999 | B1 | 11/2001 | Kueschall | |
| 7,261,309 | B2 | 8/2007 | Watwood | |
| 7,520,518 | B2 | 4/2009 | Peterson | |
| 7,735,847 | B2 | 6/2010 | Dougherty | |
| 7,766,342 | B2 | 8/2010 | Fast | |
| 8,152,192 | B2 * | 4/2012 | Dougherty | A61G 5/1089 280/304.1 |
| 8,348,293 | B1 * | 1/2013 | Lasher | A61G 5/10 16/30 |
| 8,414,008 | B2 * | 4/2013 | Hay | A61G 5/06 280/250.1 |
| 8,573,622 | B2 | 11/2013 | Papi | |
| 8,585,071 | B2 * | 11/2013 | Golden, Jr. | A61G 5/02 280/304.1 |
| 8,613,350 | B2 | 12/2013 | Nease, III | |
| 8,651,507 | B2 * | 2/2014 | Kylstra | A61G 5/10 280/250.1 |
| 8,684,113 | B1 * | 4/2014 | Laconis | A61G 5/047 180/11 |
| 9,700,469 | B2 * | 7/2017 | Golden, Jr. | A61G 5/06 |
| 9,950,733 | B2 * | 4/2018 | Golden, Jr. | B62B 19/04 |
| 10,130,530 | B2 * | 11/2018 | Golden, Jr. | A61G 5/024 |
| 2007/0096427 | A1 * | 5/2007 | Knaub | A61G 5/042 280/304.1 |
| 2011/0099857 | A1 | 5/2011 | Thomas | |
| 2012/0169025 | A1 * | 7/2012 | Golden, Jr. | A61G 5/02 280/250.1 |
| 2013/0009372 | A1 * | 1/2013 | Willis | A61G 5/02 280/86.5 |
| 2015/0001833 | A1 * | 1/2015 | Golden, Jr. | A61G 5/10 280/727 |
| 2016/0151215 | A1 | 6/2016 | Golden, Jr. | |

FOREIGN PATENT DOCUMENTS

| | | | |
|---|---|---|---|
| WO | WO/2010/139507 | A1 | 9/2010 |
| WO | WO/2011/153585 | A1 | 12/2011 |

OTHER PUBLICATIONS

Office Action for U.S. Appl. No. 14/314,030, dated Mar. 9, 2017.
Office Action for U.S. Appl. No. 14/952,810, dated Mar. 13, 2017.

* cited by examiner

RECONFIGURATION MEANS FOR A WHEELCHAIR

CROSS-REFERENCE TO RELATED APPLICATIONS

This application claims priority to, and is a continuation of, U.S. patent application Ser. No. 14/952,810 filed Nov. 25, 2015, which is hereby incorporated by reference in its entirety for all purposes.

BACKGROUND OF THE INVENTION

1. Field of the Invention

This invention relates to wheelchairs, related devices, and methods for use, particularly for transportation.

2. Description of Related Art

For many, the wheelchair serves as an essential conveyance for performing common activities that would otherwise be difficult, if not impossible, such as moving about in one's home, going shopping at the store, attending public gatherings, tending to a garden, and playing at the park with one's family. For some, such activities may be performed independently, while for others considerable assistance may be necessary; the wheelchair is thus useful in both the context of independent mobility and in that of assistive transportation of a person with a disability. Whereas the wheelchair has traditionally been viewed as an object of confinement, recent advances in wheelchair technology, improved accessibility standards, and increasingly open-minded attitudes regarding the topic of disability have elevated the wheelchair as a tool for health, personal enjoyment and freedom.

Individuals who utilize wheelchairs for their daily mobility typically do so under the direction of physicians, licensed physical therapists, and other clinicians who are well-versed in the application of adaptive mobility devices. Ideally, clinicians also educate and encourage their patients to engage in physical activity, to the greatest extent that their abilities will allow, for the sake of overall physical and psychological well-being. Such activity helps to maintain cardiovascular health, muscle strength and endurance, flexibility, range of motion, and an attitude of health and vitality. Additionally, clinical practices emphasize the independence and safety of the individual, looking at his or her day-to-day activities in the home, in the neighborhood, and in the surrounding community.

The contrast between indoor floor surfaces and outdoor terrain may vary depending on seasonal factors such as rain and snowfall, which significantly impact traction; this may be further influenced by the frequency of efforts in the locale, or lack thereof, to maintain and clear roadways, sidewalks, and driveways. For example, urban residences may benefit from prompt snow removal and de-icing services, whether by public services or by private grounds maintenance crews, whereas rural neighborhoods or farmsteads may not have access to such services. A wheelchair user residing rurally is thus likely to experience a more profound contrast between the indoor environment and that of the outdoors.

Transit in urban environments as well as long-distance travel involving transportation in vehicles such as cars, buses, trains, airplanes, small watercraft, or larger vessels, require the wheelchair user to adapt to the space allowed inside the vehicle upon boarding and to again adapt to the space outside the vehicle upon arriving at his or her destination. Quickly and successfully transitioning from one environment to the next requires knowledge and confidence on the part of the user as well as a suitably versatile wheelchair arrangement.

The aforementioned considerations are central to prior and ongoing efforts to develop adaptive devices which enable a wheelchair user, caretaker, assistant, or medical staff member to rapidly reconfigure a wheelchair according to the demands of the physical environment being encountered, especially in a manner which allows the user to remain comfortably seated throughout the process of reconfiguring the wheelchair.

SUMMARY OF THE INVENTION

In the context of technology in the art of wheelchairs and attachments therefor, the present invention concerns the challenge of wheelchair adaptability and addresses the need for rapid, robust, and versatile means for reconfiguring modern wheelchairs to meet the demands of a variety of environments to enable activities such as those illustrated above. Attempts have been made in the prior art to offer wheelchair users a solution to the need for fast and simple reconfiguration, particularly for all-terrain use, but there has remained a need for more robust, interchangeable, adjustable and customizable reconfiguration means.

Embodiments of the invention disclosed herein include a recline-action load-bearing transitioning mechanism for use with a wheelchair, the wheelchair having a frame, a pair of symmetrically-opposing rear drive wheels, and a pair of symmetrically-opposing forward primary caster wheels. The mechanism serves as a means for an occupant of a wheelchair, or an assistant thereof, to repeatably alternate the wheelchair between:

a) an original load-bearing configuration during which a load carried by the wheelchair is supported by the frame, the pair of rear drive wheels, and the pair of forward primary caster wheels, and b) a modified load-bearing configuration during which the load carried by the wheelchair is supported by the frame, the pair of rear drive wheels, and a load-transitioning mechanism integrated with a ground-contacting adaptive implement.

The mechanism thus alternates the wheelchair between the original load-bearing configuration and the modified load-bearing configuration to transform the load-bearing characteristics of the wheelchair while the wheelchair is supporting the seated occupant.

Embodiments of the present invention afford a wheelchair user improved ease and versatility by enabling the user to connect, willfully engage, willfully disengage, and disconnect the ground-contacting adaptive implement for use with the wheelchair, said adaptive implement operated by the user in conjunction with the transitioning mechanism to alternate the wheelchair between the original load-bearing configuration and the modified load-bearing configuration.

Upon willful alternation of the wheelchair to the modified load-bearing configuration, the ground-contacting adaptive implement is maintained in a deployed angular disposition during travel of the wheelchair in all directions, said adaptive implement moving in concert with movements of the wheelchair as it is motivated by the user towards a desired orientation or in a desired direction of forward or backward travel.

The ground-contacting adaptive implement may comprise a wheel, a pivotable caster, a wheeled suspension assembly, an omnidirectional wheel, a motorized wheel, a ski, a skid, or other such means for improving the user's ability to traverse difficult or unfamiliar terrain for which the unadapted wheelchair is poorly suited.

As a result of suitably reconfiguring the wheelchair to meet the demands of the terrain, the user benefits from improved forward stability of the wheelchair and decreased resistance during propulsion. Consequently, the user is relieved from excessive hand, arm, and shoulder strain and also the intense downward concentration otherwise required to avoid stones, cracks or other surface irregularities which obstruct free transit and which often pose a substantial safety issue due to the risk of tipping forward and falling out of the wheelchair. A subtle though readily noticeable result is that the user's head, neck and shoulders are maintained in a more comfortable posture, as the user is instead able to sit in a more comfortable upright position; he or she may now attend to more distant objects, enjoy taking in the surroundings, and fully relax the hands and arms after each propulsion cycle.

The mechanism is intended to be secured to at least one of the opposing forward frame tubes of the wheelchair, and the invention further comprises a user-accessible control switch to enable the user to prepare the transitioning mechanism for engaging and for disengaging the ground-contacting adaptive implement operatively connected to the transitioning mechanism without needing to exit the wheelchair or assume a difficult position while securing, operating, or releasing the device.

The mechanism defines a single joint and comprises a rotary overrunning clutch which selectably engages and disengages a rotatable portion of the joint connected to a ground-contacting implement relative to a fixed portion of the joint connected to the frame of the wheelchair. While disengaged, the rotatable portion rotates relative to the fixed portion about a substantially horizontal joint axis passing through said joint. While engaged, the rotatable portion is prevented from moving relative to the fixed portion and the rotary overrunning clutch bears torque in a first direction of rotation about the substantially horizontal axis as weight is supported through the entire mechanism and implement apparatus. Also, a rotation-limiting stop or detent prevents the rotatable portion from moving relative to the fixed portion in a second, opposing direction of rotation about the joint axis.

Embodiments of the mechanism further comprise means for locking or binding the movable portion relative to the portion affixed to the wheelchair in order to substantially increase the rigidity of the connection therebetween; locking or binding capabilities are enabled by a releasable binding assembly comprising a screw, bolt, or a quick-release cam-lever, the latter similar to the type commonly used in bicycles such as for tubular seatpost adjustment or the like. Upon securing the releasable binding assembly in a binding disposition, relative movement or "play" is effectively eliminated between the rotatable portion of the device and the portion affixed to the wheelchair, with the exception of minor relative movement produced by deformative strain or flex induced in the structural members during normal use.

While deployed, the adaptive implement is releasably and solidly unified with the frame of the wheelchair, with the ground-contacting implement maintained in a predetermined angular orientation relative to the frame of the wheelchair, by virtue of said binding means and said rotation-limiting detent.

The mechanism may be incorporated into a convertible wheelchair having permanent or semi-permanent components attached thereto, said components intended for securing and transitioning at least one of an array of specialized ground-contacting adaptive implements through an operation sequence to alternate the wheelchair between an original load-bearing configuration and a modified load-bearing configuration, with the ground-contacting implement maintained in a predetermined angular orientation relative to the frame of the wheelchair while the wheelchair is in the modified load-bearing configuration.

The present invention may also be characterized by a method in which the aforementioned mechanism is used to carry out the operation sequence necessary for attachment, engagement, disengagement, and detachment of at least one ground-contacting adaptive implement for the purpose of alternating the wheelchair between an original load-bearing configuration and a modified load-bearing configuration to transform the load-bearing characteristics of the wheelchair while the wheelchair is supporting a seated occupant.

The present invention may also be characterized by a method in which a wheelchair is equipped with the aforementioned mechanism to enable a user of the wheelchair, such as a seated occupant of the wheelchair or an assistant thereof, to carry out the operation sequence necessary for attachment, engagement, disengagement, and detachment of a ground-contacting implement to transform the load-bearing characteristics of the wheelchair while the wheelchair is supporting the seated occupant.

Alternate characterizations of the present invention which include the recline-action load-bearing transitioning mechanism for the purpose of wheelchair reconfiguration are as follows:

i. a wheelchair-attachable ground-contacting reconfiguration apparatus;
ii. a wheelchair reconfiguration system for outfitting a wheelchair with at least one ground-contacting adaptive implement; and
iii. a reconfigurable wheelchair capable of being outfitted with at least one ground-contacting adaptive implement.

In each of the aforementioned inventive settings, the included mechanism enables the user to willfully transition through a cyclic operation sequence as a means of reconfiguring the wheelchair while remaining comfortably seated in the wheelchair.

The cyclic operation sequence consists of four distinct stages: an original load-bearing or "release/attach" stage, a transitional "pre-deployment" stage, a modified load-bearing or "deployment" stage, and a transitional "pre-release" stage. In order to carry out the full operation sequence, a controlled recline maneuver is performed to engender relative rotation between the portion of the apparatus affixed to the wheelchair and the rotatable portion connected to the ground-contacting adaptive implement. Said controlled recline maneuver serves as an essential means by which the user effectuates alternating movements of the movable bearing(s) contained within the mechanism.

The controlled recline maneuver, also referred to as a "wheel-stand maneuver" or a "wheelie," involves a momentary, controlled recline motion that is a useful and well-known aspect to everyday wheelchair maneuvering and which is taught to many wheelchair users by physical rehabilitation clinicians. The wheel-stand maneuver simultaneously moves the overall user-wheelchair center of gravity rearward, reclines the seat, backrest, and frame, and elevates the front of the wheelchair. To a similar end, preferred embodiments may usefully enable an assistant to controllably recline the occupied wheelchair, such as from behind the seat of the wheelchair, while grasping handles or other rigid features affixed to or integrated with the backrest of the wheelchair.

An apparatus according to the present invention also utilizes the force of gravity for engendering said relative movement of the affixed portion and the rotatable portion about the rotation axis passing through the load-transitioning mechanism. During the wheel-stand maneuver, the apparatus is subject to angular changes of the wheelchair frame as well as the downward force of gravity acting upon the apparatus as the front of the wheelchair is elevated from contact with the ground surface. Assuming the wheelchair is situated on a level ground surface, the downward force of gravity is orthogonal with respect to an overall recline axis about which the whole wheelchair and the user's body rotate during the wheel-stand maneuver. Accordingly, preferred embodiments of the present invention are configured with the joint axis of the mechanism at the union of the affixed portion and the rotatable portion wherein relative rotation is enabled between the affixed portion and the rotatable portion, about the substantially horizontal axis, as the user controllably reclines the wheelchair.

The horizontal axis, though preferably parallel to the overall recline axis of the whole wheelchair during the wheel-stand maneuver, may instead be oriented longitudinally or diagonally with respect to the frame of the wheelchair without departing from the spirit of the invention. Furthermore, the frames of many modern wheelchairs have front angles which substantially deviate from vertical, such as those having an inward taper and a forward projection of the front tubes leading down towards the footrest; such frame geometries may impose a deviation of the joint axis of the mechanism away from being perfectly horizontal. Additionally, many wheelchairs have seat angles which substantially deviate from horizontal, such as those having a difference between front and rear height of the longitudinal seat support tubes. Thus, depending on the geometry of the frame portion to which the apparatus is attached, which may include tubing, plates, or other structural components, useful adjustment means including bolts, screws, plates, collars, clamps, or the like, may be necessary to fix the axis of the primary joint of the transitioning mechanism in a substantially horizontal orientation to properly utilize the force of gravity while performing the wheel-stand maneuver to ensure correct functioning of the transitioning mechanism.

While in the modified load-bearing configuration, the forward primary caster wheels of the wheelchair are, preferably, elevated so that they are free from contact with the ground surface, such that a clearance gap measuring at least about 5 mm is maintained below the bottom of the forward primary caster wheels as the wheelchair is rolled over a flat surface. The clearance gap may, instead, measure about 10 mm, 15 mm, 20 mm, 25 mm, 30 mm, 35 mm, 40 mm, 45 mm, or 50 mm, depending on the user's preferences. A larger clearance gap will help to ensure that the forward primary caster wheels do not contact loose or rough terrain below, but will recline the wheelchair seat rearward and will markedly alter the user's posture. On the other hand, a smaller clearance gap will increase the likelihood that the forward primary caster wheels will contact loose or rough terrain below, at times imposing increased rolling resistance, but will also maintain the user in a less reclined, more upright seated posture.

In order to reliably support downward loading due to the weight of the wheelchair and the occupant, the movable bearing of the mechanism must transmit torque through the joint of the mechanism in a manner which does not allow slipping to occur between the opposing first and second bearing surfaces, and this may be achieved through one of a variety of different types of movable bearing arrangements. Examples may be found in the prior art which exemplify useful arrangements comprising a movable bearing which is selectably engaged and disengaged for the purpose of releasably transmitting torque about a singular joint.

Some examples utilize a linearly protracting-retracting bearing arrangement. That which is described in U.S. patent application Ser. No. 14/314,030, "Unilateral transition means for adapting a wheelchair," includes the provision of a protracting and retracting load-transmission assembly to alternate a movable bearing into and out of a torque-bearing position. In U.S. Pat. No. 6,308,804, "Quick connect wheelchair brake lock," a rotary lock system is described in which a cone-shaped actuator pin contained within a load-bearing pin housing is alternated by a cam-actuated slide mechanism between a protracted position and a retracted position relative to a chamfered receiving hole, for the purpose of inhibiting rotation of a wheel. In both cases, torque is transmitted through—or alternatively stated, rotation is inhibited relative to—the movable bearing from a first bearing surface to an opposing, second bearing surface.

Other examples, such as those found in the art of roller-based and sprag-based overrunning clutches, employ arcuate movement of a movable bearing about the axis of a primary joint to engender releasable torque transmission. Arcuate or circumferential movement of at least one movable bearing by a cage, or similar means of applying urging force thereagainst, urges the movable bearing into and out of a wedged disposition between opposing first and second bearing surfaces of the primary joint, for the purpose of transmitting torque—or for inhibiting relative rotation—in a desired direction between a first bearing surface and an opposing, second bearing surface. Examples can be found in U.S. Pat. No. 2,427,120, "Two-way overrunning clutch," U.S. Pat. No. 3,476,226, "Overrunning clutch with controlled operation," and U.S. Pat. No. 7,261,309, "Wheelchair drive mechanism."

In an embodiment of the present invention, a ratchet-pawl overrunning clutch mechanism comprises a pivotable pawl which functions as a movable bearing; the mechanism further comprises an engagement surface and has a primary pivot joint having a rotatable portion connected to a ground-contacting implement and a fixed portion connected to the frame of the wheelchair. Articulated rotation of the pawl about its own pawl pivot joint permits selectable load-bearing captivation of the pawl between a first bearing surface and a second bearing surface to releasably transmit torque between the opposing first and second bearing surfaces. Said joints exhibit a slight amount of rotational play to allow for free rotation of the pawl upon alternation to the original load-bearing configuration by way of the user manipulating the switch of the transitioning mechanism and subsequently performing the wheel-stand maneuver. The pawl and the second bearing surface may both further comprise a plurality of teeth to promote engagement therebetween and to ensure that slipping does not occur during the modified load-bearing mode.

In all embodiments, the first bearing surface and the second bearing surface are configured with sufficient clearance therebetween to allow for translation or rotation of the movable bearing, or a combination of these movements, upon urging of the movable bearing in the selected direction and performing the wheel-stand maneuver. In addition, the first and second bearing surfaces are materially composed to withstand compressive contact with the movable bearing while also permitting release from contact upon arming the mechanism to sustainedly urge the movable bearing away from contact and upon subsequently performing the wheel-stand maneuver to effectuate said release from contact.

The mechanism further includes a reversible force sustainment subassembly to enable the user to selectably place the mechanism in either a state of sustainedly urging the movable bearing towards contact with the bearing surfaces or a state of sustainedly urging the movable bearing away from said contact. In preferred embodiments of the present invention, the reversible force sustainment subassembly comprises a manipulable switch operatively connected to at least one force sustaining spring, wherein the force sustaining spring is capable of sustainedly supplying an urging force to the movable bearing and wherein the force sustaining spring is further capable of removing said urging force. A suitable force sustaining spring may be a compression spring, an extension spring, or a torsion spring, operatively interposed between a user-controlled actuator, such as a knob or handle, and a cage of the overrunning clutch adapted for displacing a movable bearing or a plurality thereof.

In preferred embodiments, force sustainment means are purely mechanical and combine with a releasable overrunning clutch to form a mechanically-actuated load transitioning mechanism, wherein said manipulable switch comprises a knob or handle, a lever arm, and said force sustaining spring is composed of steel, stainless steel, nickel, titanium, or an alloy thereof, or a suitable elastomer, wherein the spring is capable of assuming a relaxed form and a deflected, extended, compressed or otherwise tensed form.

In other embodiments, force sustainment means are purely electromechanical and combine with a releasable overrunning clutch to form an electromechanically-actuated load transitioning mechanism, wherein said manipulable switch comprises an electrical or electronic switch, button, or sensor, and said force sustainer comprises an electromagnet, a stepper motor, or the like.

Yet other embodiments may include a combination of mechanical and electromechanical elements, wherein force sustainment means are of a hybrid design and combine with a releasable overrunning clutch to form a hybrid mechanical-electromechanical load transitioning mechanism; such a mechanism would comprise, for example, an electronic switch integrated with a stepper motor and an opposing mechanical force sustainer such as a torsion spring.

In purely mechanical embodiments, a variety of switch and spring arrangements may be usefully implemented to serve as force sustainment means and remain within the spirit and scope of the present invention. Embodiments of the mechanism, which require a first sustaining force application means and a second, opposing sustaining force application means, may comprise any combination of extension, compression, or torsion springs or, alternatively, may comprise any other type of solid elastomeric element, in order to enable biasing of an overall "net" urging or sustaining force applied against the movable bearing. In some purely mechanical embodiments, the included reversible force sustainment subassembly comprises a single force sustainer, such as a spring, capable of deflecting in both a forward and a reverse direction to provide sustained force application against the movable bearing for selectable engagement and disengagement.

Also in purely mechanical embodiments, force sustainment means may include a cam and lever arrangement wherein upon rotating the lever about an axis passing through the cam, the cam imparts an alternation of the urging force against the movable bearing, thus enabling the user to repeatably toggle the mechanism between an engaging state and a disengaging state by manipulably imparting rotation to the cam, via the lever, between two alternate positions.

Force sustainment means may include a linearly protracting-retracting assembly, as disclosed in U.S. patent application Ser. No. 14/314,030, wherein upon initially depressing or sliding a manipulable button or knob in a forward direction, the movable bearing is locked in a protracted position and wherein a second depression or sliding of the button or knob in the forward direction will retract the movable bearing into a retracted position, and wherein the sequence of protraction and retraction can be repeated.

Especially in the case of a roller-based or sprag-based overrunning clutch mechanism, suitable force sustainment means may include a rotatably-actuated arrangement such as a switchable rotary clutch capable of being alternated between a state of forward torque-bearing and a state of zero or reverse torque-bearing, wherein a switch lever is configured to be positioned along an arcuate path and to revolve about a rotary axis passing centrally through the load-transitioning mechanism. Upon the user manipulating said switch lever so that it comes to rest in a first retention groove along the arcuate path (or otherwise maintained in a first position), an internal spring biasing force placed upon the overrunning clutch is alternated to enable forward torque-bearing; upon the user manipulating said switch lever so that it comes to rest in a second, opposing retention groove along the arcuate path (or otherwise maintained in a second position), an internal spring biasing force placed upon the overrunning clutch is alternated to disable forward torque-bearing.

In other embodiments comprising biasing or force sustainment means as described above, reversible force application means include a first force sustainer such as a spring, elastomer, weight, magnet, or electromagnet capable of sustained force application against the movable bearing in an engaging direction and further include a second such force sustainer capable of sustained force application against the movable bearing in an opposite, disengaging direction. At times when the force applied in the engaging direction is greater than the force applied in the disengaging direction, the net force applied against the movable bearing will favor engagement of the movable bearing with both bearing surfaces. Conversely, when the force applied in the engaging direction is less than the force applied in the disengaging direction, the net force applied against the movable bearing will favor disengagement of the movable bearing from at least one of the bearing surfaces.

Whether reversible force application means comprise a single reversible force sustainer or dual opposing force sustainers, the mechanism is configured to ensure that while the adaptive implement is non-load-bearing, upon the user placing the manipulable switch in a first position the movable bearing will be urged with sufficient force to establish and maintain contact with both the first and second bearing members. Now, in this non-load-bearing pre-deployment stage, upon the user engendering relative forward rotation of the first and second bearing surfaces by performing the wheel-stand maneuver, the movable bearing will be securely captivated between the first and second bearing surfaces, thereby transitioning the mechanism to the load-bearing deployment stage.

The mechanism is also configured to ensure that, while the forward portion of the load of the wheelchair is being supported by the adaptive implement during the deployment stage, upon the user placing the manipulable switch in a second position sufficient force will be applied against the movable bearing in a disengaging direction. Now, in this load-bearing pre-removable stage, upon the user engendering slight relative reverse rotation of the first and second bearing surfaces by performing the wheel-stand maneuver, the movable bearing will release from frictional binding or captivation between the first and second bearing surfaces, allowing it to instantly move away from its position of load-bearing engagement, thereby transitioning the device to the non-load-bearing releasable stage in which the user is enabled to remove the adaptive implement from the wheelchair.

Force sustainment means may comprise a user-manipulable switch housed separately from, though operatively connected to or in communication with, the movable bearing. Remote actuation, for the purpose of controlling the urging forces applied against the movable bearing, may instead be accomplished by transmitting linear force through an ensheathed cable, a flexible rotary shaft, or by wired or wireless electronic means.

Force sustainment means, such as those described above, effectively translate a momentary manipulation of the switch by the user into a sustained application of force against the movable bearing to enable performance of the wheel-stand maneuver at a later, separate instant, to facilitate transitioning the mechanism through the cyclic operation sequence. In preferred embodiments, the duration of a switch manipulation event is substantially less than the duration of force application against the movable bearing, such as at least about one or two seconds less or at least about several seconds less. The duration of force application against the movable bearing may, in some embodiments, last as long as the user waits before performing the wheel-stand maneuver. In other embodiments, particularly those imposing electronic control, the duration of force application may be regulated to be sustained only for a predetermined number of seconds or minutes. In either case, the resulting delay affords the user, upon toggling the switch, a sufficient amount of time to situate him- or herself in an upright seated position to comfortably and safely perform the wheel-stand maneuver.

It will be appreciated by those skilled in the art that the transition from the release/attach stage to the deployment stage involves the same intuitive, intentional actions that are required to carry out the transition from the deployment stage back to the release/attach stage. Advantageously, the user is afforded the ability to ready the device for transitioning, and then attend to performing the wheel-stand maneuver at a later instant, thereby making the operation simple for the user to carry out. Furthermore, the user is prevented from accidentally transitioning the device from the deployment stage to the release/attach stage as it is unlikely that he or she will unknowingly toggle the manipulable switch and unintentionally perform the wheel-stand maneuver. As a result, the user enjoys a safe and predictable experience both while the wheelchair is in its modified load-bearing configuration and during all moments of transitioning through the cyclic operation sequence.

Embodiments of the invention include forward rotation limiting means, such as a forward limit stop, to define a rotational endpoint in a forward direction of rotation, beyond which the ground-contacting adaptive implement is prevented from further rotation about the axis of the joint as the user performs the wheel-stand maneuver. In some embodiments, said rotation limiting means are disposed locally—that is, within or directly connected to the housing of the mechanism. The forward limit stop may be externally connected to a portion of the joint or, alternatively, contained inside the protective housing, wherein a rotary projection contacts the forward limit stop during relative rotation of the first joint member and the second joint member. In other embodiments, a rotation-limiting projection is disposed remotely, such as a bar or stand-off attached to the support arm which connects the adaptive implement to the housing of the mechanism, said rotary projection configured to contact a portion of the frame of the wheelchair as the user performs the wheel-stand maneuver, similarly defining the rotational endpoint in the forward direction of rotation. Whether disposed locally or remotely relative to the housing of the mechanism, it may be useful to include a compressible elastomeric element on at least one of the two opposing contact surfaces to enable a very slight degree relative rotation to transition the mechanism from the pre-release stage to the release/attach stage, upon compression of said elastomeric element between the movable joint member and the fixed joint member when performing the wheel-stand maneuver.

In some embodiments, it may be advantageous to incorporate a cam and lever assembly with the rotation limiting bar, stand-off or rotation-limiting projection to enable the user to impose relative tension among the movable bearing and the first and second bearing surfaces during the deployment stage to help increase the overall rigidity of the joint; such an arrangement thus serves as a releasable means for indirectly imposing pressure against the movable bearing to inhibit relative movement between the first bearing surface and the second bearing surface. As in the preceding paragraph, it may be of use to include a compressible elastomer in the contact portion of the cam.

Alternatively, it may be preferred in some embodiments to incorporate a clamp or a cam-actuated bar adapted to enable the user to tightly draw or affix the rotary portion of the apparatus against the frame of the wheelchair or against a portion of the apparatus fixed thereto, for the purpose of inhibiting movement of the rotary portion and thus increasing the rigidity of the connection of the adaptive implement to the wheelchair.

In some embodiments, it may be preferable to incorporate, within the protective housing, a cam and lever assembly comprising a tensioning skewer, said cam and lever assembly configured to releasably apply pressure or tension directly against the movable bearing, especially after the user has transitioned the mechanism to the deployment stage of operation, at which time it is most desirable to rigidize the joint.

Embodiments may thus include releasable means for both indirect and direct binding of the movable bearing in a fixed position to inhibit relative movement between the first bearing surface and the second bearing surface. Whether utilized separately or in combination, such means for inhibiting relative movement between opposing bearing surfaces (and thus, opposing joint members) serves to add rigidity to the union between the wheelchair and the attached ground-contacting adaptive implement, which is especially useful in situations where flutter of the adaptive implement is more likely to occur due to vibration. In addition, direct or indirect inhibition of bearing movement helps to further prevent accidental transition of the load-transitioning mechanism during use. Therefore, such provisions for rigidizing the joint during the deployment stage of operation confer enhanced stability and reliability, in turn improving the performance and safety of the vehicle during use.

The mechanism is enclosed within a protective housing to keep out dirt, debris, and moisture to prevent unwanted wear and corrosion of the bearing components, force sustainers, and related structures.

The option of adapting the same wheelchair in a variety of configurations would be appreciated by a person experienced in the art of adaptive wheelchair mobility as being advantageous as a consequence of the versatility afforded to the user. Active wheelchair users, for example may wish to utilize such a means for recreation, exercise, or for enjoyment of scenic or otherwise enjoyable locations outdoors which might include nature trails, playgrounds, grassy fields, snow-covered areas, and muddy or swampy areas. Other activities may be performed out of necessity, such as negotiating a rough gravel driveway or other path to access a garage, mailbox or wood shed. Occupational, avocational, and "everyday" activities which may be addressed at least in part by embodiments of the present invention include outdoor chores such as maintaining trees, shrubs, gardens, and other landscaping work, which at the very least require the individual to be able to negotiate terrain that is unlikely as flat and smooth as indoor floor surfaces.

Asymmetric configurations may be desirable in cases where a single laterally-attached implement is sufficient for performing the task at hand. As an example, it may be suitable to use a single large all-terrain caster implement to place the wheelchair in a three-wheel configuration wherein the primary casters of the wheelchair are elevated and unloaded and the all-terrain caster implement is positioned in front of the wheelchair and in alignment with a vertical longitudinal centerline passing through the wheelchair. Examples are illustrated in U.S. patent application Ser. No. 13/249,278, "Asymmetric open-access wheel chair" and in U.S. Pat. No. 8,585,071, "Releasable forward wheel apparatus for a wheelchair," both of which are herein incorporated by reference in their entirety. In such examples, a single caster imparts additional forward stability and reduced rolling resistance to the wheelchair while also permitting the user to transfer to and from the seat of the wheelchair with minimal obstruction to the user's legs and feet at a forward lateral region of the wheelchair.

Whether utilizing symmetric or asymmetric attachment configurations, it is necessary to ensure releasable, secure alignment and retention of attached adaptive implements connected to the frame of the wheelchair. For the sake of versatility and convenience, embodiments include provisions for switching out or swapping different ground-contacting adaptive implements for the purpose of quickly reconfiguring the wheelchair, preferably to enable interchangeable attachment of an array of adaptive implements to the wheelchair.

Provisions to ensure releasable, secure alignment and retention may include:

a) insertable alignment pins, such as those having a ball and a spring configured to resist pullout, or a positively locking ball detent mechanism to ensure pullout does not occur unless a button is depressed;
b) an expanding insertion pin, wherein compressive force holds the pin in tight engagement within a receptacle to establish a unified, "play-free" and "wiggle-free" connection between the separable adapting member and the mounting member;
c) a coupling comprising a solid or tubular insert having a round profile, used in conjunction with an anti-rotation collar for preventing rotation of coupled members;
d) couplings comprising solid or tubular inserts having polygonal, spline, or keyed profiles for preventing rotation of coupled members;
e) quick-release collars for releasably securing coupled members.

In preferred embodiments, the adaptive implement is secured relative to a forward portion of the wheelchair in a releasable fashion, including simple, fast and easy means of attaching and releasing the entire apparatus to and from the forward portion of the wheelchair. In variations thereof, a system according to the present disclosure may be configured for leaving a mounting member attached to the wheelchair, whether clamped, bolted, welded or otherwise permanently or removably secured to the wheelchair, to facilitate attaching and releasing of the apparatus by way of a separable adapting member comprising quick-release features.

In preferred embodiments of the invention, the joint of the mechanism and all attachment components are sufficiently rigid so that the performance, safety, and longevity of all fixed and movable components of the transitioning mechanism, as well as those secured to the wheelchair, are substantially unaffected by torsional strain and asymmetric loading placed upon the apparatus as a result of a load borne completely or in part by the apparatus.

Sufficient movement of the movable bearing is necessary to enable rapid and reliable attachment, operation, and detachment to successfully transition the device through the cyclic operation sequence. In particular, the joint of the mechanism must exhibit a minimum degree of rotation during the pre-release stage to enable transition to the release/attach stage, such as at least about 0.5 degrees, or at least about 1.0 degrees, or at least about 2.0 degrees, or at least about 5.0 degrees of relative rotation between the first and second bearing surfaces. A sufficiently robust joint helps to isolate this requisite rotation without introducing unwanted play or wiggle of the joint and ensures strong, secure and play-free load-bearing engagement of the movable bearing between the first and second bearing surfaces during the modified load-bearing mode.

Advantages set forth by embodiments of the present invention may be achieved by exploiting at least one lateral portion of the wheelchair which, especially in the case of rigid-type "everyday" wheelchairs, is predominantly devoid of structural components and accessories. Patents such as U.S. Pat. No. 7,520,518, "Wheelchair," issued to Peterson, et al. and U.S. Pat. No. 6,311,999, "Wheelchair with a closed three-dimensional frame," issued to Kueschall, and U.S. Pat. No. 8,573,622, "Wheelchair," issued to Papi, which exemplify modern wheelchairs and architectures thereof, may be useful for visualizing the relevant lateral regions of such wheelchairs and for appropriately applying transition means for purposes described herein. In many cases, the aforementioned lateral region is suitable, spatially and structurally, for accommodating elements necessary for reliable attachment of adaptive devices to robust portions of the wheelchair and for convenient operation of the load-transitioning mechanism, including manipulation of the switch by the user.

In a first embodiment configuration of the present invention a single load-transitioning mechanism connects an adaptive implement, in an asymmetric fashion, to a lateral portion on a first side of the wheelchair. In a second embodiment configuration, a first load-transitioning mechanism connects a first adaptive implement to a lateral portion on a first side of the wheelchair and a second load-transitioning mechanism connects a second adaptive implement to a lateral portion on a second, opposing side of the wheelchair. In a third embodiment configuration, a single load-transitioning mechanism connects one or more adaptive implements to opposing lateral portions on both sides of the wheelchair in a symmetric, bilateral fashion. In each of the aforementioned cases, significant torsion is likely to be experienced due to imbalanced loading which occurs either due to lateral placement of the apparatus or simply by virtue of asymmetric contact of the adaptive implement with the ground surface. Therefore, proper functioning of all embodiments the present invention must withstand imbalanced or asymmetric forces placed upon clamping members, support members, and bearing members.

An additional aim of the present invention is to ensure that, while detached, the adaptive implement remains correctly adjusted so that it may be reliably re-attached to the wheelchair and engaged in a position which confers optimal performance. In meeting these challenges together, embodiments of the present invention enable precise, repeatable alternating of the wheelchair between the original load-bearing mode during which the forward portion of the load carried by the wheelchair is fully supported by the primary caster wheels, and the modified load-bearing mode during which the forward portion of the load is at least partially supported by the ground-contacting adaptive implement.

It will be appreciated by persons skilled in the art that embodiments of the present invention further comprise features which facilitate securing and removal of the device and for carrying out the cyclic operation sequence by a diverse population of users exhibiting a broad range of abilities, especially regarding manual dexterity and upper body strength. Features included in embodiments of the invention, such as oversized quick-release lever handles, contoured knobs, push-buttons, and the like, for example, make it easier for individuals having reduced manual grip strength and sensation to be able to tighten a quick-release collar or to actuate a manipulable control switch associated with a load-transitioning mechanism.

Further, some embodiment configurations may be suitable for use by individuals capable of leaning down, from a seated position, and accessing lower portions of the wheelchair frame for attachment and detachment purposes, whereas alternate embodiment configurations may be needed by individuals who are more comfortable remaining in a substantially upright seated position. A user, for example, who is strong and flexible enough to reach down and secure a transitioning apparatus to a portion of the frame about 12 inches above the ground will likely enjoy the benefit of having a clamping-type transitioning apparatus wherein the entire device may be removed to minimize the weight of the wheelchair when the device is not needed. A user who prefers to remain seated upright, on the other hand, may find it more practical to configure her wheelchair with a non-removable mounting member capable of accepting an attaching member of the apparatus which is separable from the mounting member, the mounting member being semi-permanently secured to the frame of the wheelchair and disposed at a higher and more rearward location such as about three inches below the seat and about midway between the front of the frame and the front of the rear drive wheel.

For added convenience to the user, embodiments may include provisions for stowing adaptive implements behind or beneath the seat of the wheelchair while the wheelchair is in its original load-bearing configuration. Clamps, clips, perches, or other connectors may be utilized for releasably securing adaptive implements at locations on the wheelchair which are unobtrusive and which are easy for the user to access.

Preferred embodiments are lightweight, compact, durable, and aesthetically appealing, which are exemplified by designs, components, construction methods and materials utilized in the bicycle industry and which have gained widespread use in adaptive wheelchair sports and recreation equipment. Modular design principles, such as standardization and partitioning, may be utilized to reduce manufacturing costs, increase the number of configuration options, and allow for proper, customized fitting to a wider range of makes and models of existing wheelchairs available in the marketplace.

BRIEF DESCRIPTION OF THE DRAWINGS

The above-mentioned features of the invention will become more clearly understood from the following detailed description of the invention read together with the drawings in which:

FIG. 8B shows how the concept is applicable to adaptive implements other than those comprising wheels, such as ski-type ground-contacting implements.

DETAILED DESCRIPTION OF THE DRAWINGS

Figure 1:
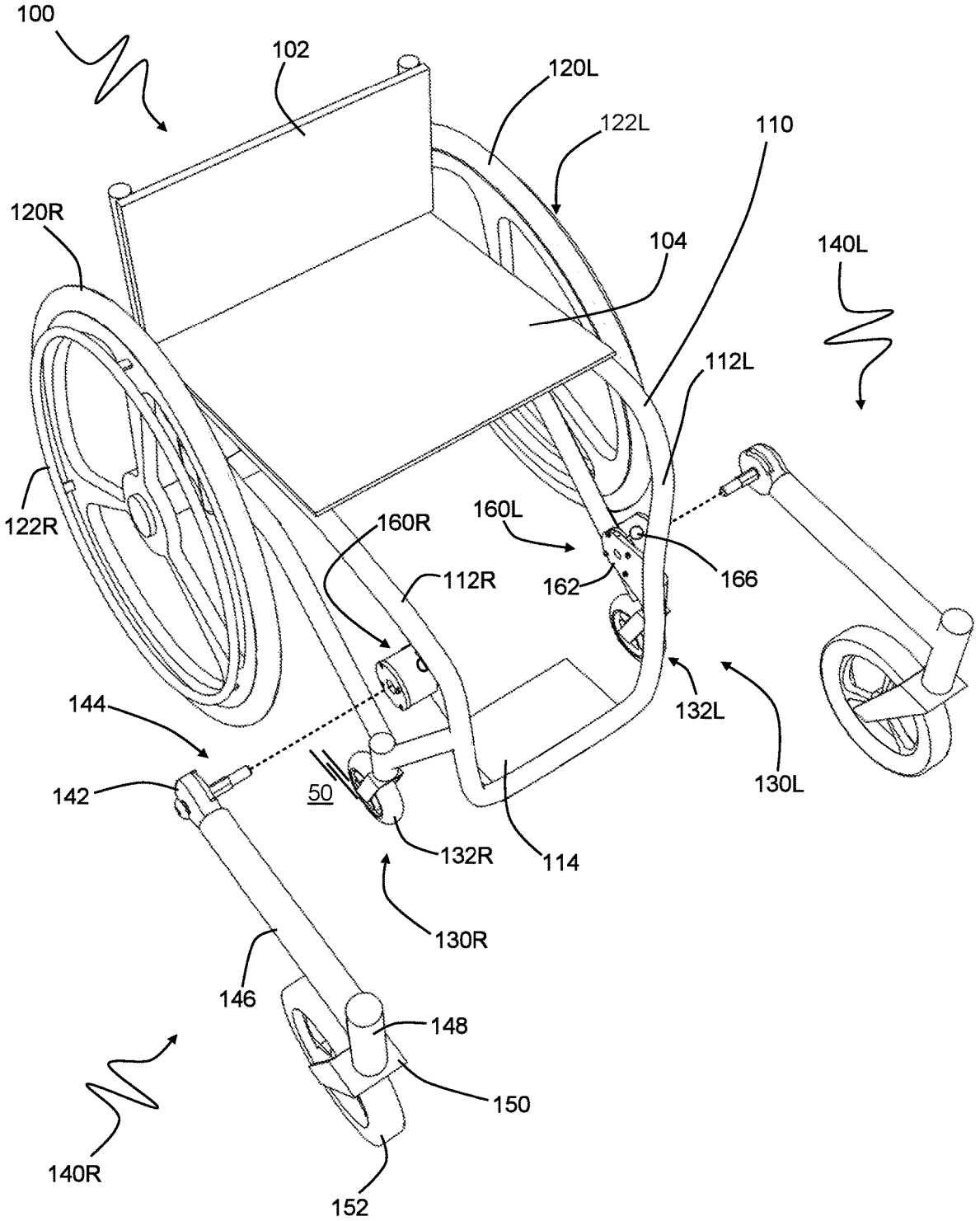
FIG. 1 shows a wheelchair capable of being reconfigured with dual symmetrically opposing (left and right) adaptive caster wheel assemblies which attach laterally to left and right transitioning mechanism assemblies affixed to opposing sides of the frame of the wheelchair.

The drawings described hereinafter are intended for the purpose of illustration rather than limitation.

The term "mechanism" as used hereinafter refers to an assembly forming a joint, the mechanism assembly comprising: an overrunning clutch comprising a first joint body having a first bearing surface, said overrunning clutch further comprising a second, opposing joint body having a second bearing surface, said overrunning clutch further comprising at least one movable bearing disposed between the first bearing surface and the second bearing surface, the movable bearing being capable of moving into and out of a position of force transmission between the first bearing surface and the second bearing surface; the mechanism assembly further comprising a force sustainment subassembly comprising a manipulable biasing switch and a forward-force sustaining spring, the force sustainment subassembly adapted to be toggled between: a.) a first biasing state, wherein the forward-force sustaining spring is deflected in a forward direction by the manipulable biasing switch to apply a forward sustaining force to the movable bearing to preload the movable bearing to enable movement of the movable bearing into a position of load-bearing torque transmission between the first and second bearing surfaces, and b.) a second biasing state wherein the forward-force sustaining spring is relaxed by the manipulable biasing switch to remove the forward sustaining force from the movable bearing to enable the movable bearing to move out of the position of load-bearing torque transmission between the first and second bearing surfaces.

The terms "apparatus" and "device" as used hereinafter refer to an assembly which includes the mechanism described in the preceding paragraph and which further includes: releasable attachment means such as a coupling or a clamp subassembly for connecting the adapter to a frame of a wheelchair; and extended ground-contacting means such as an adaptive wheel, ski, or other implement for conferring modified functionality to the wheelchair.

To facilitate understanding of the figures, structural elements located on the right side of the wheelchair as well as any attachments thereto, from the perspective of an occupant of the wheelchair, have been labeled with the suffix "R" following the numeral corresponding to the structural element. Similarly, structural elements located on the left side of the wheelchair and any attachments thereto have been labeled with the suffix "L" following the numeral corresponding to the structural element. In cases where the aforementioned labeling convention does not aid in understanding a particular figure, the suffix has been omitted and only the numeral has been used. For example, the left-side rear drive wheel is referred to by label "120L," and the right-side rear drive wheel is referred to by label "120R"; however, in a side-view illustration wherein 120L cannot be visibly distinguished from 120R, the rear drive wheels are collectively referred to by using label "120."

FIG. 1 depicts a wheelchair 100 having back support 102, seat 104, structural frame 110, foot support 114, rear drive wheels 120L and 120R having a diameter between about 20 and 26 inches, and pivotable front caster assemblies 130L and 130R having a diameter between about 3 and 5 inches. Rear drive wheels 120L and 120R support a rearward portion of the load carried by the wheelchair, including both a portion of the weight of a seated occupant (not shown) and a portion of the weight of the wheelchair itself. The wheelchair 100 is propelled, steered and slowed by the occupant gripping the rear drive wheels 120L and 120R or pushrims 122L and 122R attached to said rear drive wheels 120L and 120R and applying muscle-derived force thereagainst to control the movement of the wheelchair 100. In an original, unadapted configuration, primary caster wheels 132L and 132R contact and roll over the ground surface 50 and support a forward portion of the load carried by the wheelchair, including both a portion of the weight of the occupant and a portion of the weight of the wheelchair itself. Load-bearing, in the original, unadapted configuration, is thus shared among primary caster wheels 132L and 132R and rear drive wheels 120L and 120R. As the wheelchair moves in a desired direction, the primary caster wheels 132L and 132R passively align in an orientation such that the horizontal rotational axis of each of the primary caster wheels 132L and 132R trails behind the vertical pivot axes of its respective pivotable caster assembly. As a result, the pivotable portion of each caster wheel assembly pivots about its respective vertical pivot axis in response to changes in the direction of the wheelchair enacted by the user.

The wheelchair 100 is configured with transitioning mechanism assemblies 160L and 160R secured to opposing lateral portions 112L and 112R of the structural frame 110 of the wheelchair 100. Securing of the transitioning mechanism assemblies 160L and 160R may be accomplished by welding, bolting, or clamping to the structural frame 110. Each of the transitioning mechanism assemblies 160L and 160R has a generally cylindrical profile and is disposed at a location which does not infringe upon the space normally occupied by the occupant's legs, yet which is within reach so that the occupant may easily toggle or otherwise manipulate a control knob 166 disposed on each transitioning mechanism assembly 160L and 160R. Ideally, the location of each of the transitioning mechanism assemblies 160L and 160R also enables the occupant to easily connect each of two opposing auxiliary caster wheel assemblies 140L and 140R to a transitioning mechanism assembly 160L or 160R on its respective side of the wheelchair 100. Dashed lines in FIG. 1 illustrate the path of lateral insertion which aligns each caster wheel assembly with its respective transitioning mechanism assembly 160L or 160R.

Each of the auxiliary caster wheel assemblies 140L and 140R comprises a wheel 152 that is substantially larger than that of the primary caster wheels 132L and 132R, such as at least about 5 inches in diameter, or at least about 6 inches in diameter, or at least about 8 inches in diameter, or at least about 10 inches in diameter, or at least about 12 inches in diameter. Depending on the terrain a user desires to traverse, it may also be useful for the auxiliary caster wheel 152 to be substantially wider, such as at least about 10 percent wider than the primary caster wheels, in order to increase the surface area of the region of contact with the ground surface. Useful widths of the auxiliary caster wheel 152 may be at least about 20, 40, 60, 80, 100, 120, 140, 160, or 180 percent wider than the primary caster wheels. Extremely wide auxiliary caster wheels may have a ground-contacting tread region up to 200 percent, up to 300 percent, or up to 400 percent or more of the width of the primary caster wheels. The auxiliary caster wheel 152 is held within a caster fork 150 which is connected to a pivotable bearing housing 148. The pivotable bearing housing 148 is connected to support arm 146. Support arm 146 is connected to movable rotary support body 142, through which a positive locking pin assembly 144 projects.

Figure 2A:
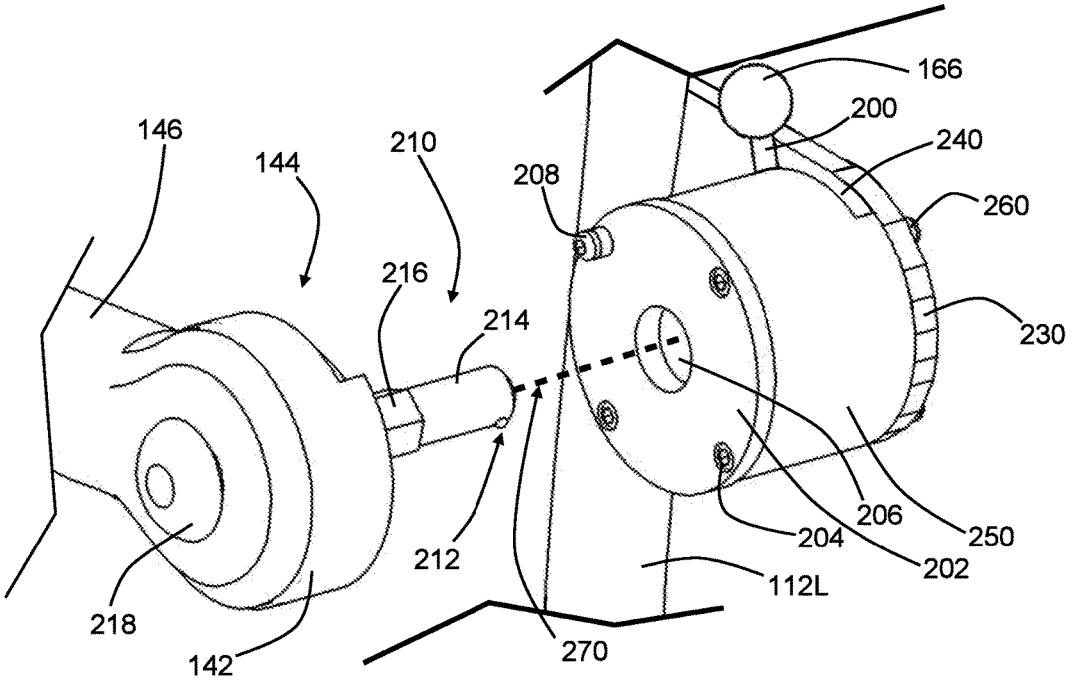
FIGS. 2A and 2B are close-up views of the left-side transitioning mechanism assembly prior to affixing the left-side adaptive caster wheel assembly.
Figure 2B:
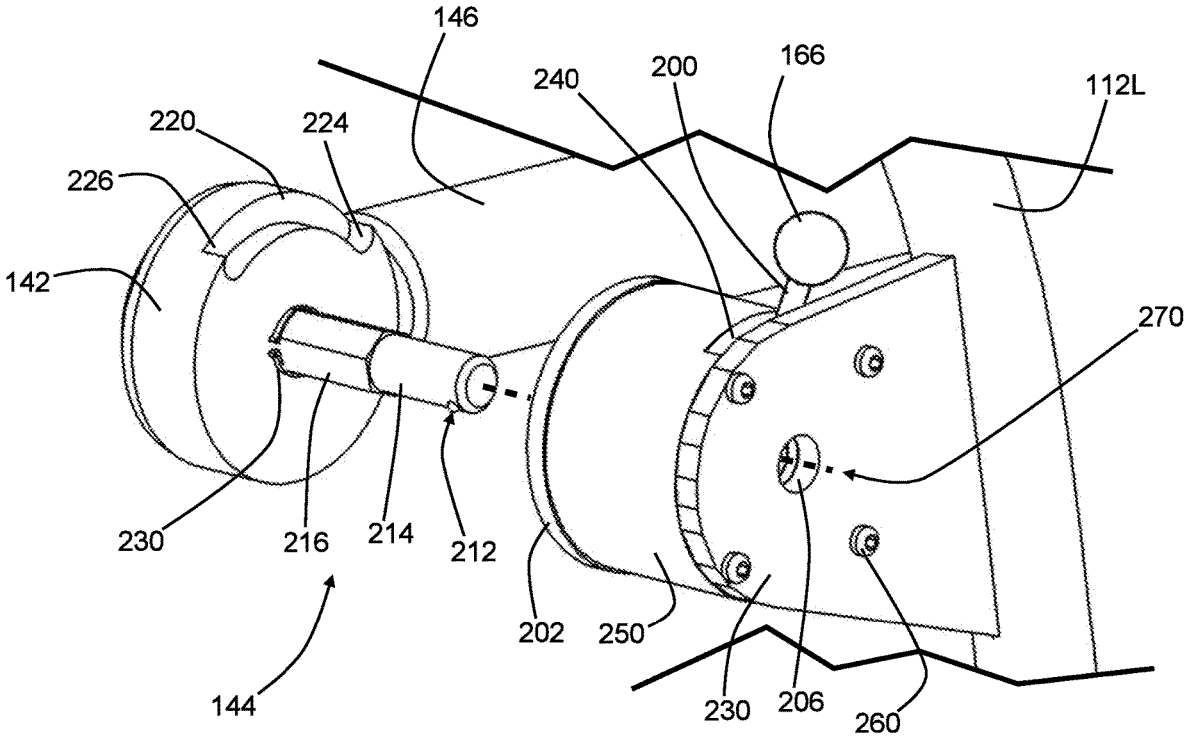

FIGS. 2A and 2B show close-up views of the movable rotary support body 142 of auxiliary caster wheel assembly 140L, while unattached, in its alignment with transitioning mechanism assembly 160L, with transitioning mechanism assembly 160L secured to the lateral portion 112L of the structural frame of the wheelchair. Dashed line 270 indicates the path of lateral insertion which aligns auxiliary caster wheel assembly 140L with transitioning mechanism assembly 160L.

A lateral enclosure plate 202 having outer aperture 206 is secured to a fixed cylindrical housing 250 with machine screws 204. The fixed cylindrical housing 250 is secured to an inner enclosure plate 230 with machine screws 260, said inner enclosure plate 230, in this illustration, being welded to the lateral portion 112L of the structural frame 110 of the wheelchair 100.

Secured in place by retention clip 230 and projecting through a central hexagonal aperture of the generally cylindrical-shaped movable rotary support body 142 is positive locking pin assembly 144 comprising a push button 218 which, upon the user applying manual pressure thereto using the hand, thumb, or fingers, allows spherical ball detent 212 to assume a retracted position thereby permitting the cylindrical stem portion 214 of the positive locking pin assembly 144 to pass through the transitioning mechanism assembly 160L and exit aperture 206 of welded enclosure plate 230. Upon fully inserting the positive locking pin assembly 144 into the receiving aperture 206 and upon the user releasing manual pressure from the push button 218, the spherical ball detent 212 assumes via outward spring pressure a protracted position to maintain the positive locking pin assembly 144 in its inserted position relative to the transitioning mechanism assembly 160L. By way of the positive locking pin assembly 144, the auxiliary caster wheel assembly 140L is thus releasably connected to the transitioning mechanism assembly 160L and is reliably maintained in a position relative to the structural frame 110 of the wheelchair 100. Furthermore, the positive locking pin assembly 144 serves as a pivot means comprising a central, generally lateral axis of rotation about which the entire auxiliary caster wheel assembly 140L will rotate as the user carries out the sequence of steps necessary to attach, use, and detach the device.

Also visible in FIGS. 2A and 2B are the cylindrical portion 214 and the grip portion 216 of the positive locking pin assembly 144. The grip portion 216 has a hexagonal cross-sectional profile and, upon full insertion of the positive locking pin assembly 144 into the transitioning mechanism assembly 160L, mates with and achieves full contact within a hexagonal grip receptacle (not shown) of a load transfer spindle (not shown) to allow torque transmission to occur from the auxiliary caster wheel assembly 140L to an overrunning clutch (not shown) contained within the fixed cylindrical housing 250 of the transitioning mechanism assembly 160L.

Upon fully inserting the positive locking pin assembly 144 into the transitioning mechanism assembly 160L, travel-limiting element 208 occupies an arcuate travel-limiting passageway 220 of the solid body 220. The arcuate travel-limiting passageway 220 comprises a forward limit stop 224 which defines a rotational endpoint in a first direction of rotation of the auxiliary caster wheel assembly about the central axis of the positive locking pin assembly 144. The arcuate travel-limiting passageway 220 also comprises a rearward limit stop 226 which defines a rotational endpoint in a second direction of rotation of the auxiliary caster wheel assembly about the central axis of the positive locking pin assembly 144.

An arcuate notch or recess machined into the fixed cylindrical housing 250 forms a handle passageway 240 along which a lever handle 200 travels as the user toggles or otherwise manipulates the control knob 166 to switch the load-bearing state of the overrunning clutch (not shown) contained within the fixed cylindrical housing 250 of the transitioning mechanism assembly 160L.

In FIGS. 2A and 2B, the control knob 166 and lever handle 200 are shown in a forward rotational position corresponding to an internal state of disengaging spring pressure. Control knob 166 and lever handle 200 serve to receive manual input force enacted by the user for transferring said manual input force to effectuate a state alternation of the force sustainment subassembly which, as a result, is selectably toggled between a first biasing state and an opposing second biasing state. Alternation between the two opposing internal states of spring pressure enables the user to prepare or "arm" the mechanism so that the overrunning clutch (not visible) contained within the fixed cylindrical housing 250 of the transitioning mechanism assembly 160L will subsequently be alternated in its capacity for load-bearing torque transmission upon the user performing the wheel-stand maneuver.

Figure 3:
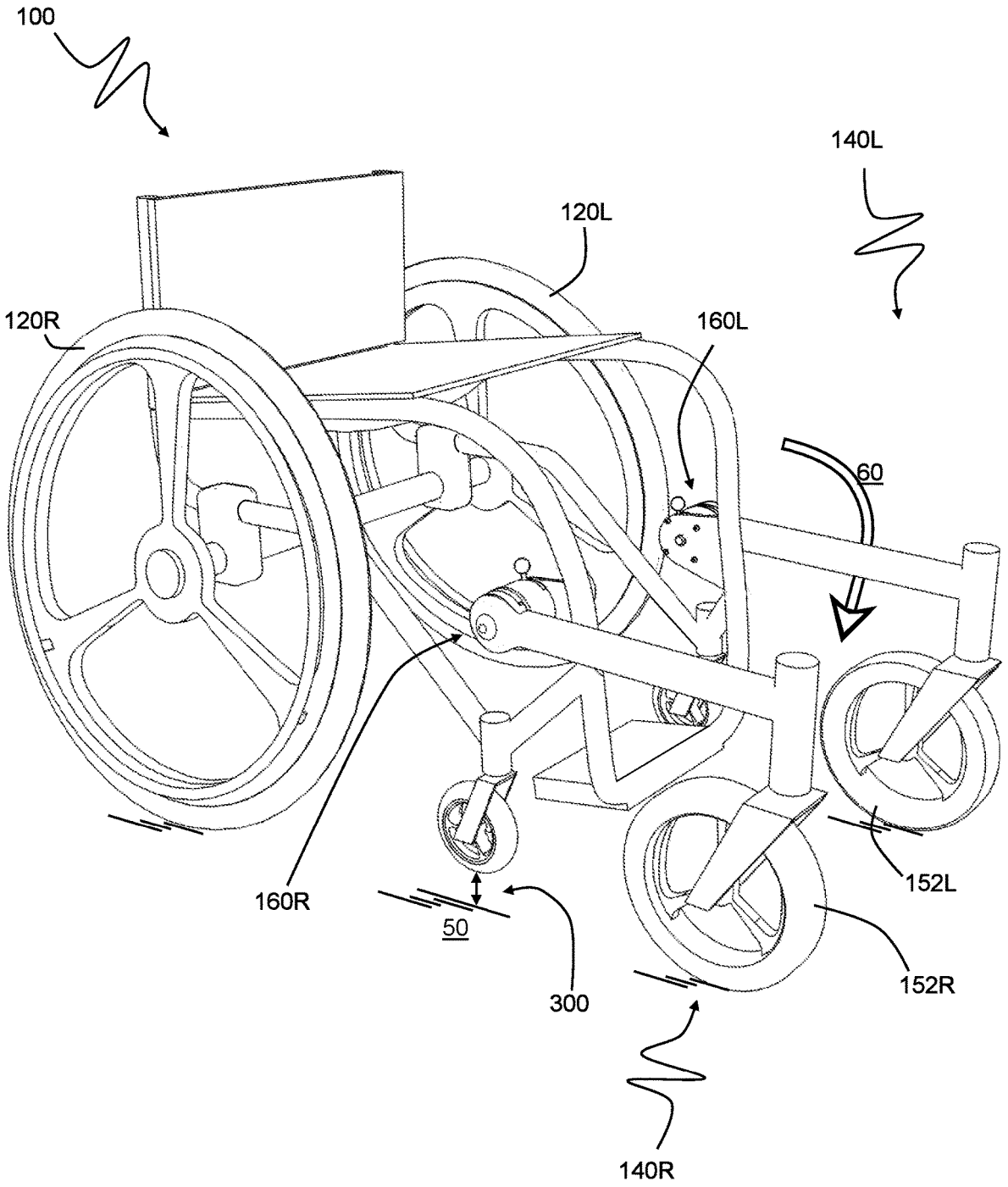
FIG. 3 shows the wheelchair of FIGS. 1-2B having both adaptive caster wheel assemblies attached and deployed, the wheelchair thus being maintained in a modified load-bearing mode.

FIG. 3 depicts the wheelchair 100 with attached auxiliary caster wheel assemblies 140L and 140R after the control knob 166 and lever handle 200 have been manipulated to occupy a rearward rotational position (corresponding to an internal state of engaging spring pressure) and also after the wheelchair 100 has been reclined substantially to elevate the primary caster wheels 132L and 132R off the ground surface 50. This reclining action or "wheel-stand maneuver," whether it be performed by an assistant or, preferably, by the occupant of the wheelchair, lifts the front end of the wheelchair 100 to create a gap 300 beneath the primary caster wheels 132L and 132R and, at the same time, causes rotation of the auxiliary caster wheel assemblies 140L and 140R in the first direction of rotation, indicated by direction arrow 60.

Engaging spring pressure, as a result of the user having manipulated the control knob 166 and the lever handle 200, causes the internal overrunning clutch (not shown) to allow rotation of the auxiliary caster wheel assembly 140L in the first direction of rotation, indicated by direction arrow 60, but prevents rotation thereof in the opposite direction. As a result, upon reclining the wheelchair sufficiently to cause the travel-limiting element 208 to contact the forward limit stop 224 (as previously presented in FIGS. 2A and 2B) the auxiliary caster wheel assembly 140L is subsequently maintained in this position and is substantially prevented from attaining any change in position relative to the structural frame 110 of the wheelchair 100. The forward portion of the load that was previously supported by the primary casters while the wheelchair was in its unadapted state is now distributed to the auxiliary caster wheel assemblies 140L and 140R. Auxiliary caster wheels 152L and 152R, as depicted in FIG. 3, are in full contact with the ground surface.

Figure 4A:
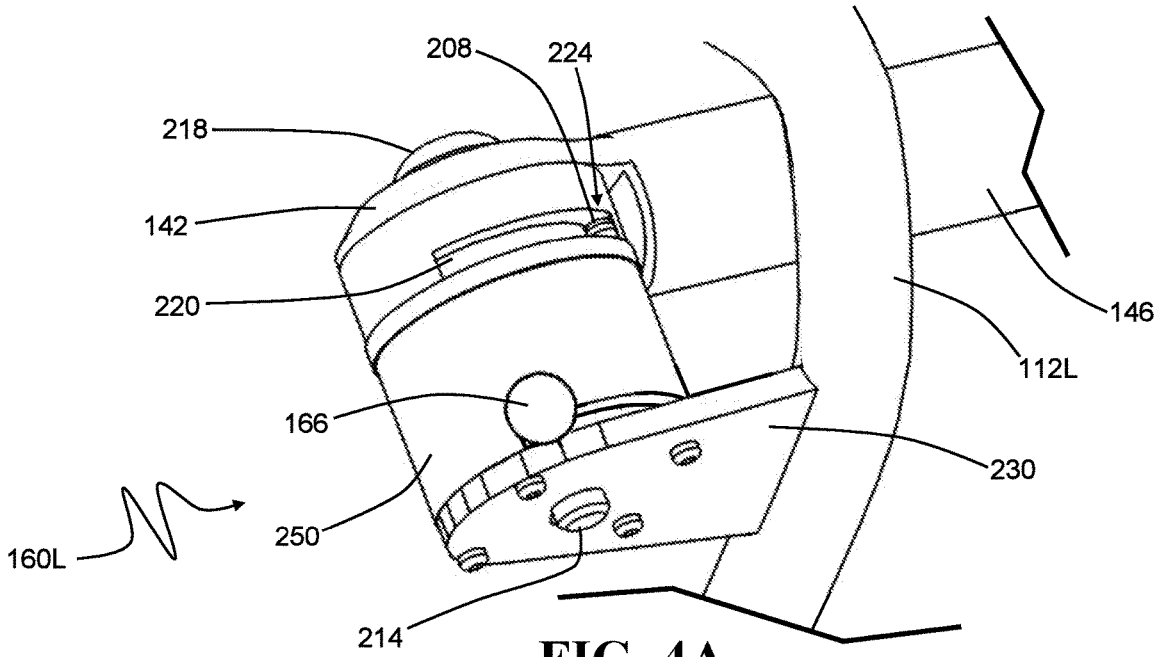
FIGS. 4A and 4B are close-up views of the left-side transitioning mechanism assembly after affixing the left-side adaptive caster wheel assembly and transitioning the apparatus to the deployment stage of operation.
Figure 4B:
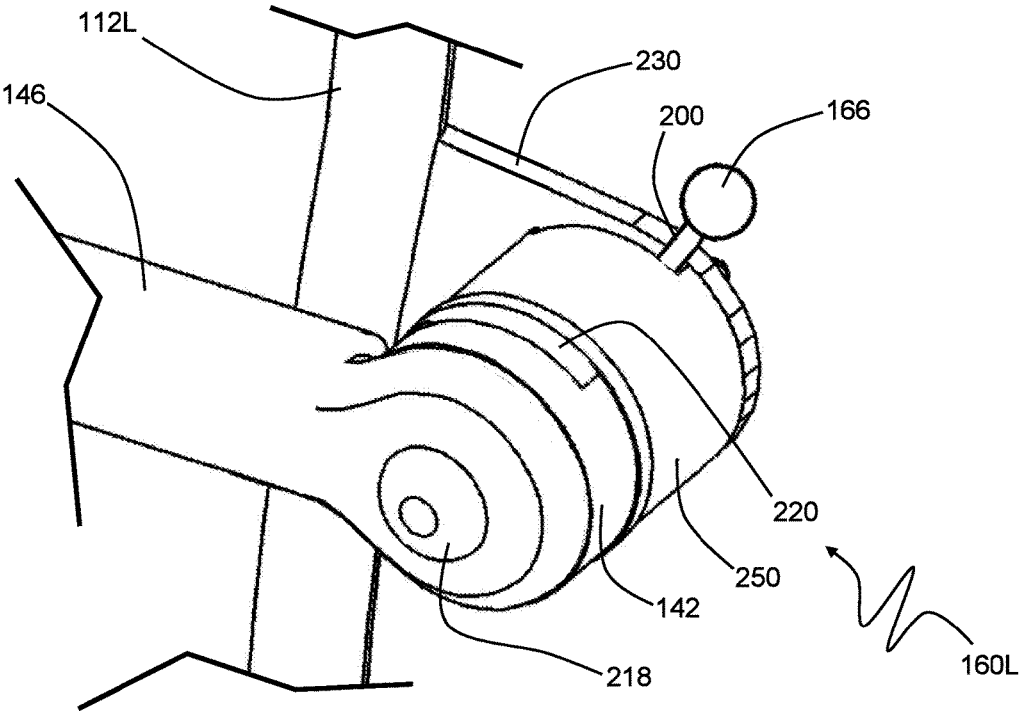

FIGS. 4A and 4B show close-up views of the movable rotary support body 142 of auxiliary caster wheel assembly 140L while attached to the transitioning mechanism assembly 160L. The travel-limiting element 208 is nested against the forward limit stop 224 of the movable rotary support body 142. The control knob 166 is occupying the rearward rotational position, corresponding to an internal state of engaging spring pressure.

Figure 5A:
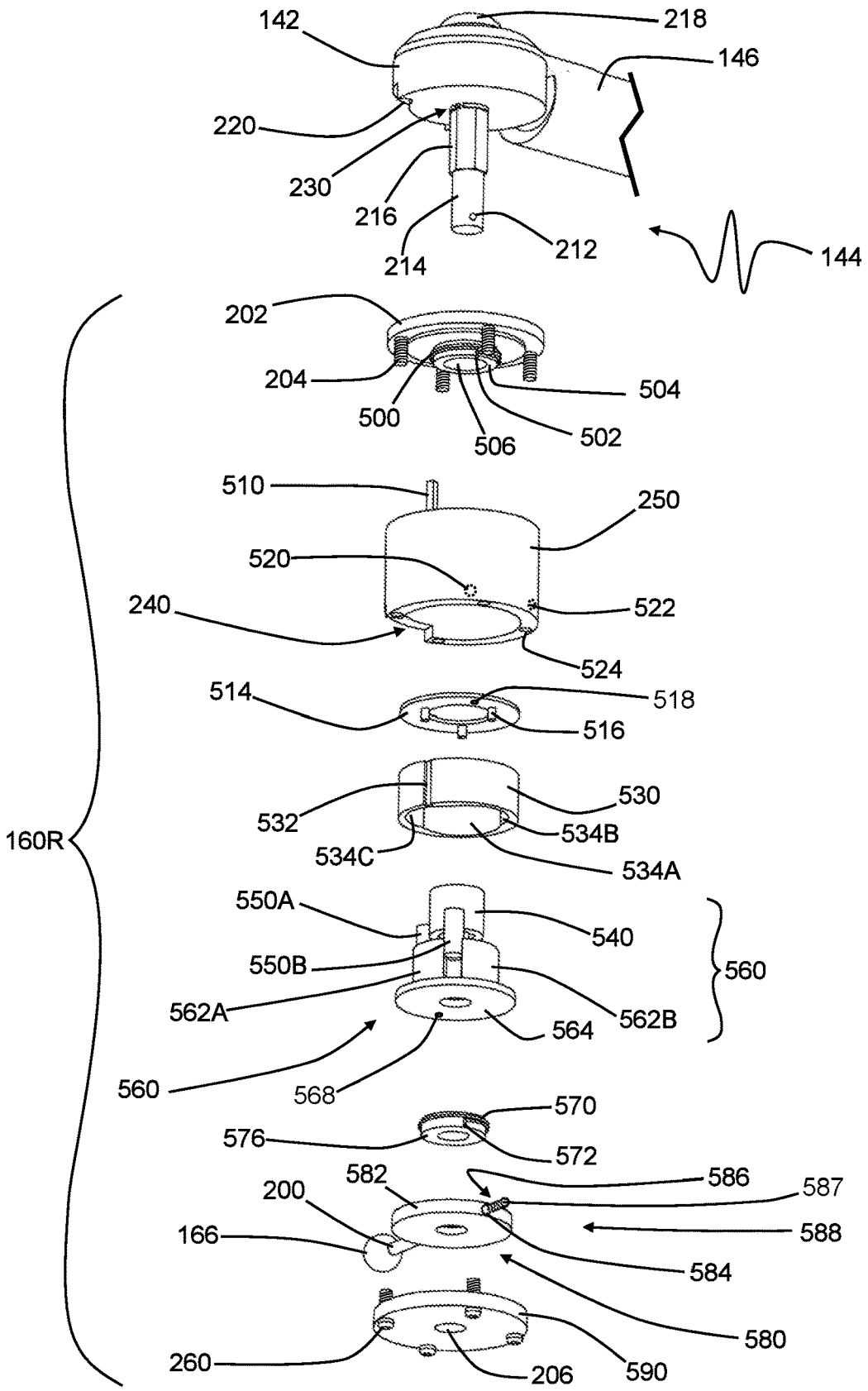
FIGS. 5A and 5B are exploded views of the right-side transitioning mechanism assembly.
Figure 5B:
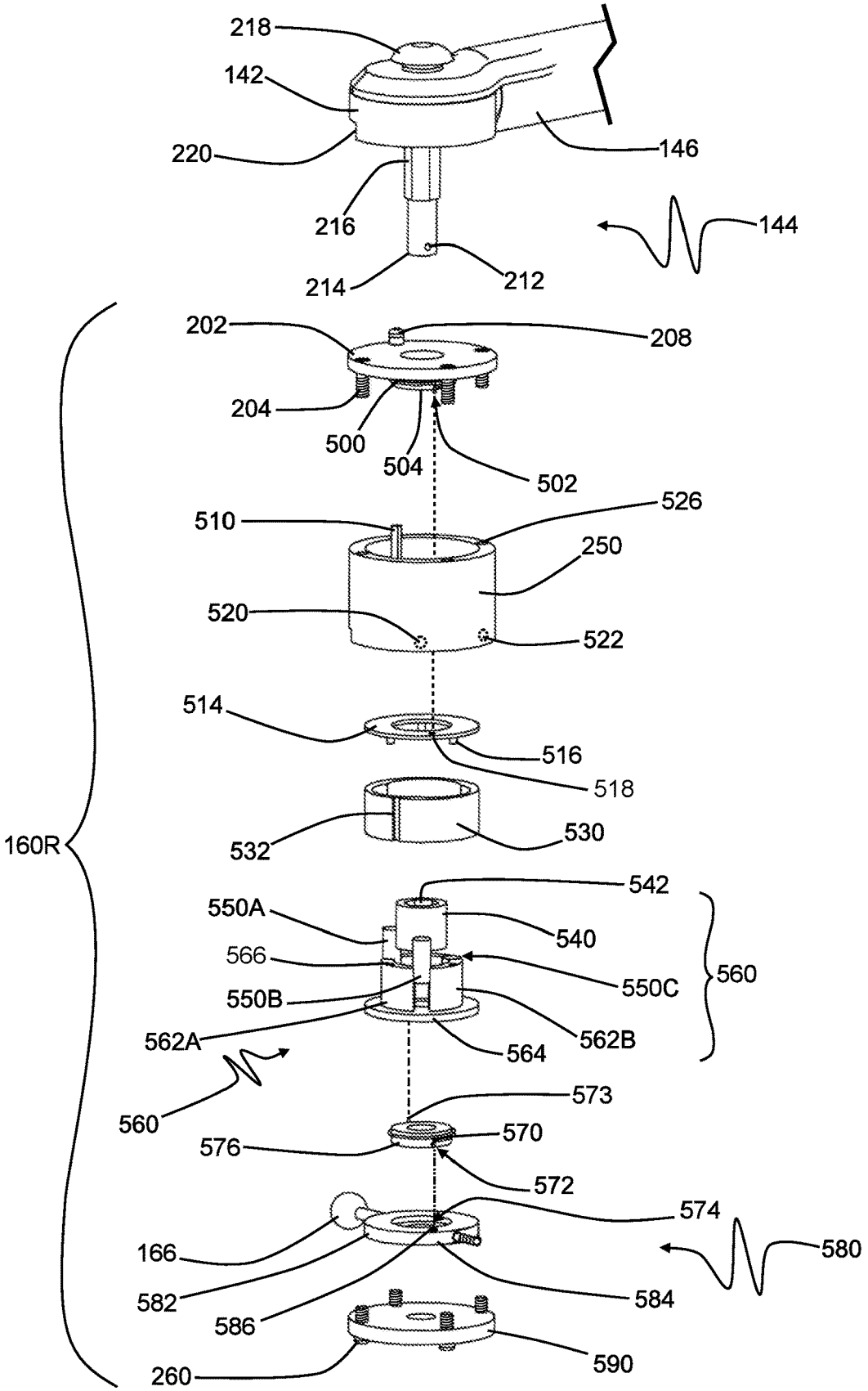

FIGS. 5A and 5B show exploded views of a transitioning mechanism assembly 160R aligned with positive locking pin assembly 144 having cylindrical portion 214 and grip portion 216. Near the center of each drawing is fixed cylindrical housing 250 having machine screw holes 524 on its interior side for receiving machine screws 260 for securing the inner enclosure plate 590 (which is analogous to the inner enclosure plate depicted in previous figures) and machine screw holes 526 on its outer side for receiving machine screws 204 for securing the outer enclosure plate 202. The fixed cylindrical housing 250 is intended to be rotationally secured relative to the structural frame 110 of the wheelchair 100, which may be accomplished by means such as welding, clamping, or bolting the fixed cylindrical housing 250 or the inner enclosure plate 590 to the structural frame 110.

Press-fitted inside the fixed cylindrical housing 250 is an outer bearing member 530 having a plurality of circular depressions 534A, 534B, and 534C. The outer bearing member 530 and the fixed cylindrical housing 250 are secured in alignment by insertion of key 510 into the keyway formed by channel 532 disposed on the outer surface of the outer bearing member 530 and a channel (not shown) disposed on the inner surface of the fixed cylindrical housing 250.

The outer bearing member 530 is flanked on its outer side by rotary spacer 514 having a spring tab receiver hole 518 and a plurality of alignment projections 516, and the outer bearing member 530 is flanked on its inner side by rotary plate 564 of roller body cage 560. Upstanding elements 562A, 562B, and 562C (not visible) project through the outer bearing member 530. Alignment holes 566 receive the alignment projections 516 to rotationally secure the rotary spacer 514 relative to the roller body cage 560.

Disposed centrally within the roller body cage 560 is a load-transfer spindle 540 which is cylindrical in shape and comprises a hexagonal grip receptacle 542 configured as a counterpart for receiving the grip portion 216 of the positive locking pin assembly 144.

Disposed between the upstanding elements 562A, 562B, and 562C are cylindrical roller bearing elements 550A, 550B, and 550C, which are the same length as the load transfer spindle 540 and which are dimensioned so as to remain out of contact with the inner bearing surfaces of the circular depressions 534A, 534B, and 534C while the roller body cage 560 is urged by a second force-sustaining torsion spring 570 in the forward direction (the same direction of rotation as that indicated by direction arrow 60 shown previously in FIG. 3). When the roller body cage 560 is not urged by the second force-sustaining torsion spring 570, a first force-sustaining torsion spring 500 urges the roller body cage 560 in the reverse direction (counter to the direction of rotation indicated by direction arrow 60 shown previously in FIG. 3) so that the cylindrical roller bearing elements 550A, 550B, and 550C are forced into and remain in wedging, load-bearing contact between the outer bearing member 530 and the load-transfer spindle 540. The roller body cage 560 in combination with the cylindrical roller bearing elements 550A, 550B, and 550C, the load transfer spindle 540 and the outer bearing member 530, therefore, form a roller bearing type overrunning clutch.

First force-sustaining torsion spring 500, having a first tab (not visible) extending into the outer enclosure plate 202 and a second tab 502 extending into the spring tab receiver hole 518 of the rotary space 514, is fitted around mandrel 506. The first force-sustaining torsion spring 500 is preferably pre-loaded such that it tends to impart rotation of the roller body cage 560 in the reverse direction.

Second force-sustaining torsion spring 570, having a first tab 572 extending into spring tab receiver hole 586 of direction control plate 582 and a second tab 573 extending into spring tab receiver hole 568 of rotary plate 564, is fitted around mandrel 576 and sandwiched between rotary plate 564 of the roller body cage 560 and direction control plate 582.

Viewing the assembly from the inner side, the first force-sustaining torsion spring 500, as depicted, is wound so that clockwise rotation of the outer enclosure plate 202 prior to assembly causes the first force-sustaining torsion spring 500 to "wind up" in the clockwise direction so that it will have a tendency to impart clockwise rotation of the roller body cage 560. The second force-sustaining torsion spring 570 is wound in the same direction so that counter-clockwise rotation of the direction control plate 582, resulting from counter-clockwise manipulation by the user, will cause the second force-sustaining torsion spring 570 to "wind up" in the counter-clockwise direction so that it will have a tendency to impart counter-clockwise rotation of the roller body cage 560. The roller body cage 560 is thus operatively interposed between the first force-sustaining torsion spring 500 and the second force-sustaining torsion spring 570.

When the direction control plate 582 is placed in its most counter-clockwise position, the second force-sustaining torsion spring 570 applies a maximum amount of counter-clockwise force to the roller body cage 560 and overcomes the pre-loaded clockwise force applied by the first force-sustaining torsion spring 500. In this case, the internal spring state is biased towards moving and maintaining the roller body cage 560 in a rotary position which causes the cylindrical roller bearing elements 550A, 550B, and 550C to bind or wedge between the outer bearing member 530 and the load-transfer spindle 540. If the mechanism is presently in its "release/attach" stage and the user manipulates the control knob 166 to rotate the direction control plate 582 in the counter-clockwise direction, the mechanism is effectively transitioned to its "pre-deployment" stage during which it is readied for transitioning to the "deployment" stage but is not yet bearing any load. Subsequent reclining of the wheelchair 100 then transitions the mechanism to its "deployment" stage during which it is load-bearing and downward force placed on the forward portion of the wheelchair is transmitted through the elements of the roller bearing type overrunning clutch.

When the direction control plate 582 is placed in its most clockwise position, the second force-sustaining torsion spring 570 applies a minimum amount of counter-clockwise force to the roller body cage 560, and said counter-clockwise force is readied to be overcome by the pre-loaded clockwise force applied by the first force-sustaining torsion spring 500, in which case the internal spring state is biased towards moving and maintaining the roller body cage 560 in a rotary position which enables the cylindrical roller bearing elements 550A, 550B, and 550C to release from their bound contact between the outer bearing member 530 and the load-transfer spindle 540. If the mechanism is presently in its "deployment" stage and the user manipulates the control knob 166 to rotate the direction control plate 582 in the clockwise direction, the mechanism is effectively transitioned to its "pre-release" stage during which it is readied for transitioning to the "release/attach" stage but the cylindrical roller bearing elements 550A, 550B, and 550C remain in binding contact between the outer bearing member 530 and the load-transfer spindle 540. Subsequent reclining of the wheelchair 100 releases the roller bearing elements 550A, 550B, and 550C from binding contact and, in effect, transitions the mechanism to its "release/attach" stage during which it is non-load-bearing and downward force placed on the forward portion of the wheelchair is supported by the primary caster wheels 132L and 132R of the wheelchair 100.

In FIG. 5B, dashed lines are used to indicate the insertion of the spring tabs of the first force-sustaining torsion spring 500 and the second force-sustaining torsion spring 570 in their respective spring tab receiver holes.

Contained inside a cylindrical recess 584 of the direction control plate 582 is a ball-spring assembly 588 comprising a compression spring 586 and a spherical ball 587, both dimensioned accordingly to provide sufficient holding force against first and second ball receiver depressions 520 and 522, respectively, to maintain the direction control plate 582 in either a discrete forward position or a discrete reverse position yet also allow a user to easily toggle between the two positions by manipulating the control knob 166.

Figure 6A:
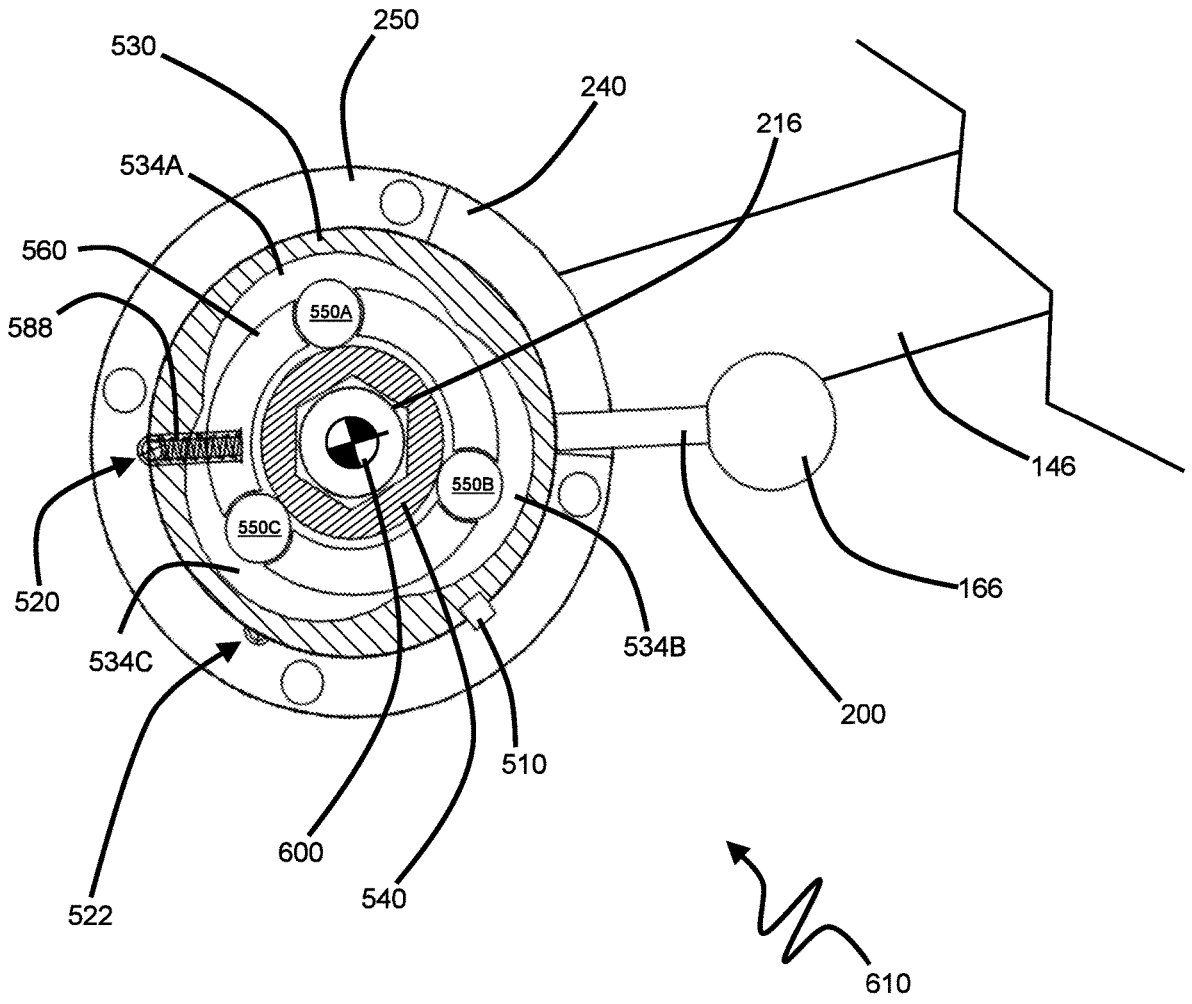
FIGS. 6A and 6B are sectional views illustrating the cyclic operation sequence as the mechanism is transitioned from a release/attach stage to a pre-deployment stage, then to a deployment stage, then to a pre-release stage, and then back to the release/attach stage.
Figure 6B:
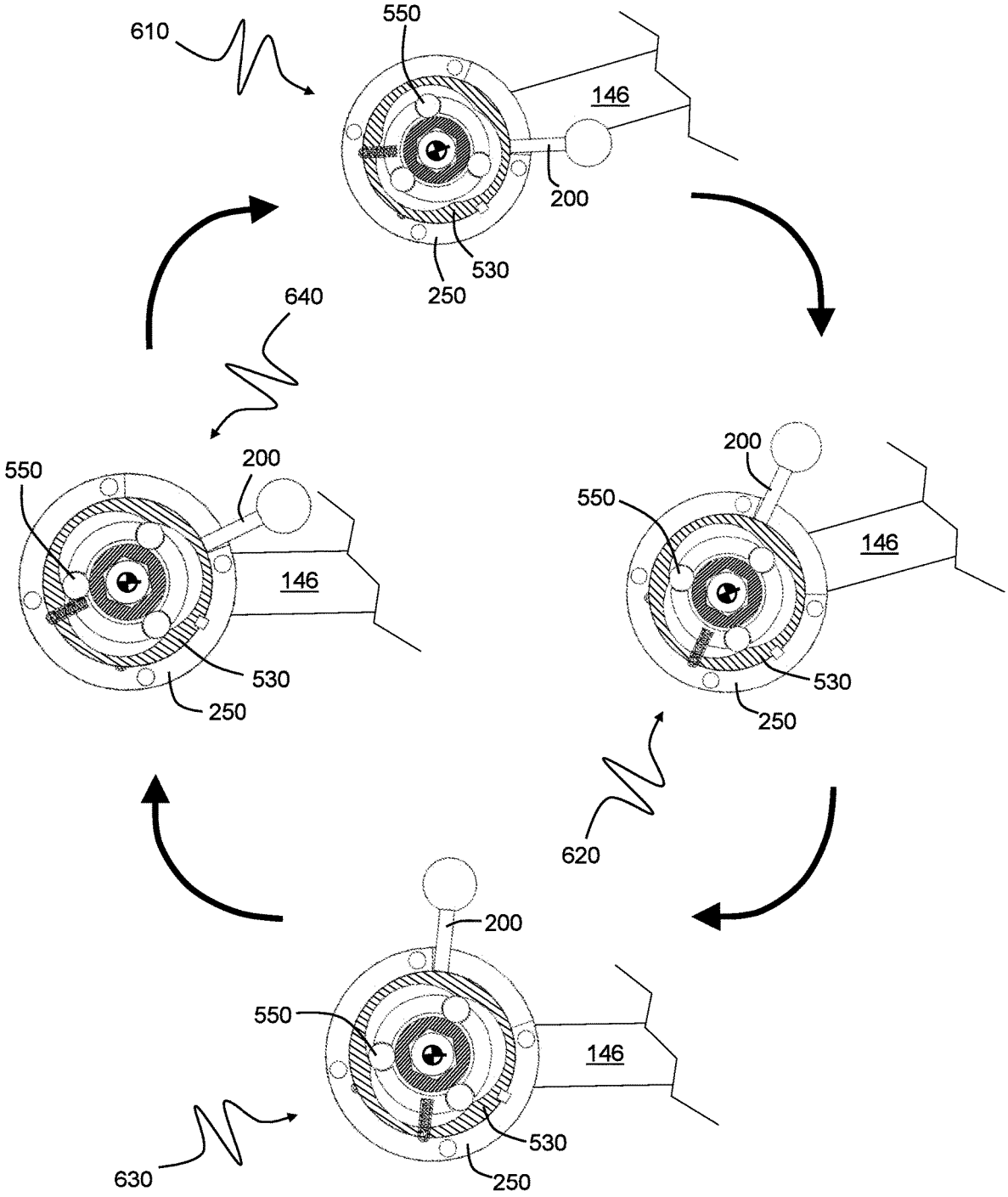

FIGS. 6A and 6B show sectional views of a transitioning mechanism assembly to illustrate the relative positioning of its moving components as it is transitioned through the four distinct stages of the operation sequence (release/attach stage, pre-deployment stage, deployment stage, pre-release stage). Symbol 600 is included in the diagrams to indicate the rotary position of the hexagonal grip portion 216 of the positive locking pin assembly 144, which corresponds to the rotary position of the support arm 146 as it rotates about the axis of the positive locking pin assembly 144.

Shown in FIG. 6A is the transitioning mechanism assembly in the release/attach stage 610, with cylindrical roller bearing elements 550A, 550B, and 550C disposed within circular depressions 534A, 534B, and 534C of the outer bearing member 530 and thus free from any bound contact between the outer bearing member 530 and the load-transfer spindle 540. Support arm 146 is free to rotate in either direction about the axis of the positive locking pin assembly 144, as long as the control knob 166 and lever handle 200 are kept in the forward rotational position (corresponding to an internal state of disengaging spring pressure) indicated in FIG. 6A. Also visible in FIG. 6A are: handle passageway 240 along which lever handle 200 travels; fixed cylindrical housing 250; key 510 (for alignment of outer bearing member 530 with fixed cylindrical housing 250); first and second ball receiver depressions 520 and 522; ball-spring assembly 588; and roller body cage 560.

FIG. 6B illustrates the cyclical operation sequence of the transitioning mechanism assembly, the operation sequence comprising release/attach stage 610, pre-deployment stage 620, deployment stage 630, and pre-release stage 640. Release/attach stage 610 is depicted just as previously shown in FIG. 6A.

In pre-deployment stage 620, lever handle 200 has been moved by the user to a reverse rotational position (corresponding to an internal state of engaging spring pressure through the roller body cage against the cylindrical roller bearing elements 550A, 550B, and 550C). Support arm 146, still in an elevated position, is now restricted to rotation about the axis of the assembly in the clockwise direction, as the cylindrical roller bearing elements 550A, 550B, and 550C become wedged between the outer bearing member 530 and the load-transfer spindle 540 to prevent rotation of the support arm 146 in the counter-clockwise direction. Rotation of the support arm 146 occurs in the clockwise direction as the user reclines the wheelchair—that is, by performing a wheel-stand maneuver or "wheelie," and the load-transfer spindle 540 rotates in the clockwise direction to assume a maximum downward position (defined by the point at which the travel-limiting element (not shown) contacts the forward limit stop) and is maintained in said maximum downward position by the cylindrical roller bearing elements 550A, 550B, and 550C.

In deployment stage 630, lever handle 200 is maintained in the reverse rotational position (corresponding to an internal state of engaging spring pressure). Cylindrical roller bearing elements 550A, 550B, and 550C are disposed against contact regions of the circular depressions 534A, 534B, and 534C of the outer bearing member 530 and thus maintained in load-bearing engagement between the outer bearing member 530 and the load-transfer spindle 540. Support arm 146 is reliably maintained in a fixed position in both directions about the axis of the positive locking pin assembly 144, as long as the control knob 166 and lever handle 200 are kept in the reverse rotational position.

In pre-release stage 640, lever handle 200 has been moved by the user to the forward rotational position (corresponding to an internal state of disengaging spring pressure). Support arm 146 is maintained in the lowered position and is supporting the forward portion of the load carried by the wheelchair, while the ground-contacting adaptive implement (not shown) attached to the end of support arm 146 is contacting the ground surface. Due to frictional contact forces between the cylindrical roller bearing elements 550A, 550B, and 550C and the outer bearing member 530 and the load-transfer spindle 540, the disengaging spring pressure is not sufficient to cause the cylindrical roller bearing elements 550A, 550B, and 550C to disengage from their binding interposition between the outer bearing member 530 and the load-transfer spindle 540, thereby enabling continued maintenance of support arm 146 in the lowered position and support of the forward portion of the load carried by the wheelchair as long as the frictional contact forces against the cylindrical roller bearing elements 550A, 550B, and 550C are maintained as a result of forward loading on the wheelchair.

With the transitioning mechanism in the pre-release stage 640, upon the user reclining the wheelchair, support arm 146 rotates slightly in the clockwise direction about the rotation axis of the assembly to allow the reverse-biased spring pressure to move the cylindrical roller bearing elements 550A, 550B, and 550C, causing them to disengage from said binding interposition between the outer bearing member 530 and the load-transfer spindle 540, instantly allowing free rotation of the support arm 146 in either direction about the axis of the positive locking pin assembly 144. A slight amount of play among roller bearing elements, the outer bearing member 530 and the load-transfer spindle 540 is required to enable said disengagement to occur, and is a phenomenon of roller clutch assemblies which has been usefully exploited in the present invention. Furthermore, reclining of the wheelchair is necessary to effectuate the transition from the pre-release stage 640 to the release/attach stage 610; the wheel-stand maneuver or "wheelie" is a natural action performed by experienced wheelchair users and has been usefully exploited herein, for both engagement and disengagement of the cylindrical roller bearing elements 550A, 550B, and 550C with the outer bearing member 530 and the load-transfer spindle 540.

Figure 7A:
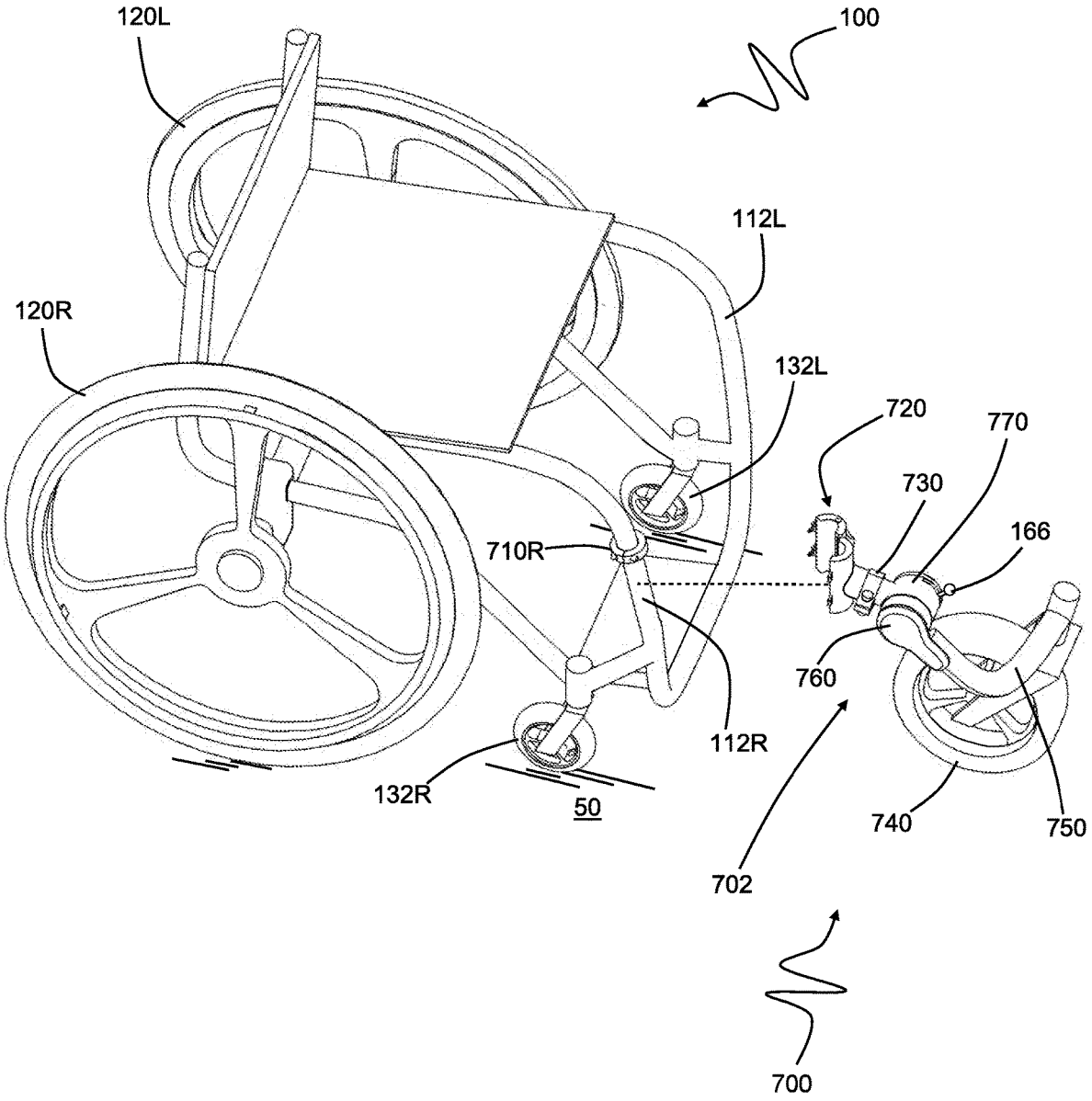
FIGS. 7A and 7B show the wheelchair prior to and after affixing an asymmetric, fully-removable, clamping-type adapter to the right side of the frame of the wheelchair, said adapter comprising a transitioning mechanism acting as a singular joint between a clamp assembly and an adaptive caster wheel assembly.

FIG. 7A depicts the wheelchair 100 ready for attachment of a clamping-embodiment apparatus 700 having an asymmetric (one-sided) caster wheel assembly. An adaptive caster wheel 740 is connected to the transitioning mechanism assembly 702 by the extension arm 750. It is important to note that the embodiment disclosed in FIG. 7A is absent a laterally-inserting positive locking pin assembly and alternatively comprises a bolt (not shown) which secures solid body 760 to cylindrical housing 770 and which defines an axis of relative rotation therebetween. A positioning collar 710R which is affixed to the lateral portion 112R of the wheelchair 100 enables a user to repeatably attach, remove and re-attach the clamping-embodiment apparatus 700 in a predetermined position and orientation relative to the wheelchair 100.

Figure 7B:
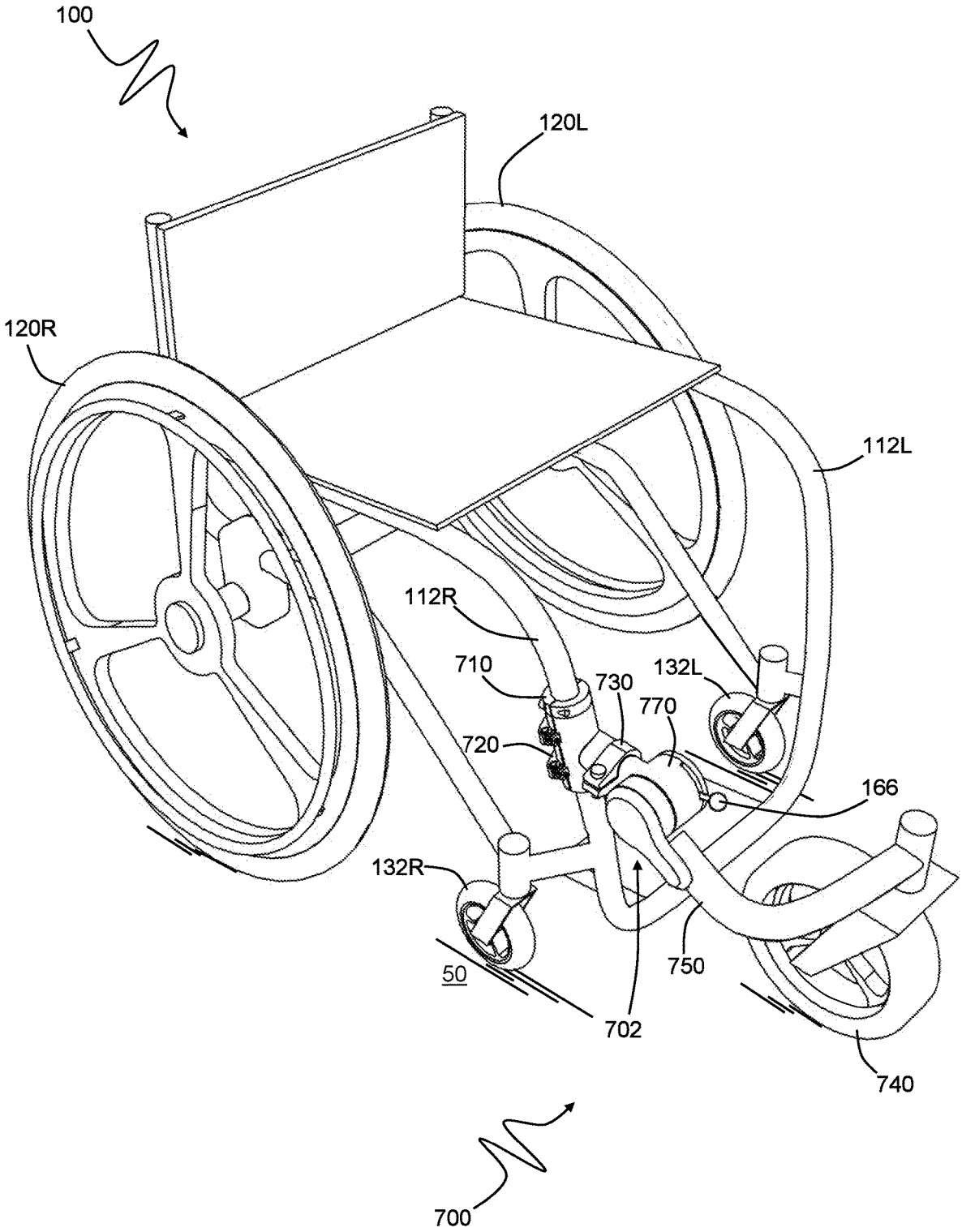

FIG. 7B depicts the wheelchair 100 having the asymmetric (one-sided) caster wheel apparatus of FIG. 7A in the release/attach stage, with the adaptive caster wheel 740 resting on the ground surface yet bearing no load and with the control knob 166 in its most forward position, corresponding to an internal state of disengaging spring pressure which urges the movable roller bearings toward a disposition free from any binding contact between the fixed portion of the transitioning mechanism assembly 702 and the movable portion thereof. The clamping-embodiment apparatus 700 is ready for either: a.) detachment from the wheelchair 100, or b.) transitioning to the pre-deployment stage.

Figure 8A:
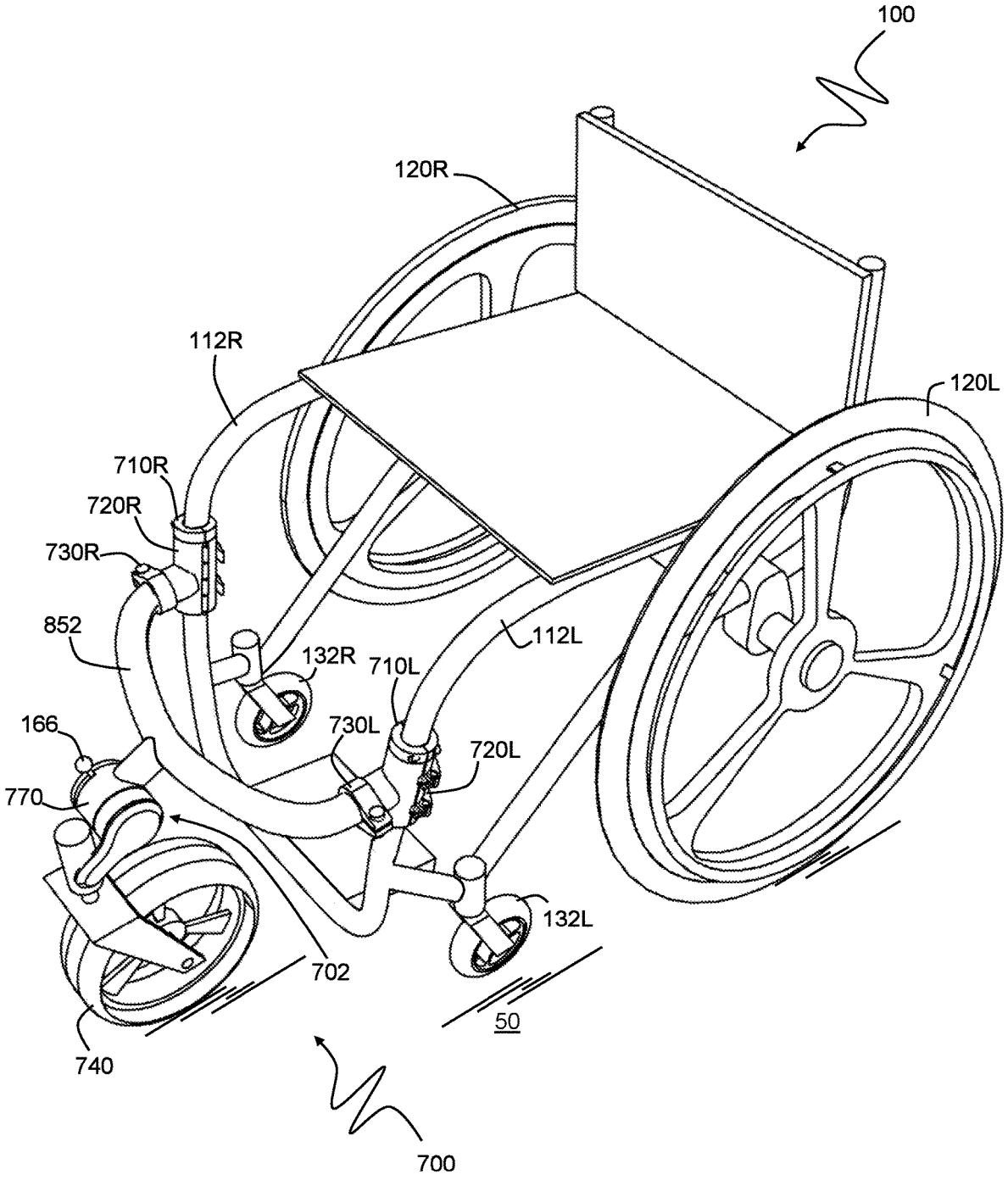
FIGS. 8A and 8B show alternate arrangements to illustrate structural and functional similarities which exist among a variety of embodiments.

FIG. 8A depicts the wheelchair 100 having a symmetrically-attaching caster wheel apparatus comprising a single transitioning mechanism assembly 702 in conjunction with two symmetrically opposing clamps configured for attachment to both the left and the right sides of the wheelchair frame. The adaptive caster wheel 740 is supporting the forward portion of the load carried by the wheelchair 100, whereas the primary caster wheels 132L and 132R of the wheelchair 100 are substantially elevated above the ground surface 50 and thus fully relieved of any loading.

Figure 8B:
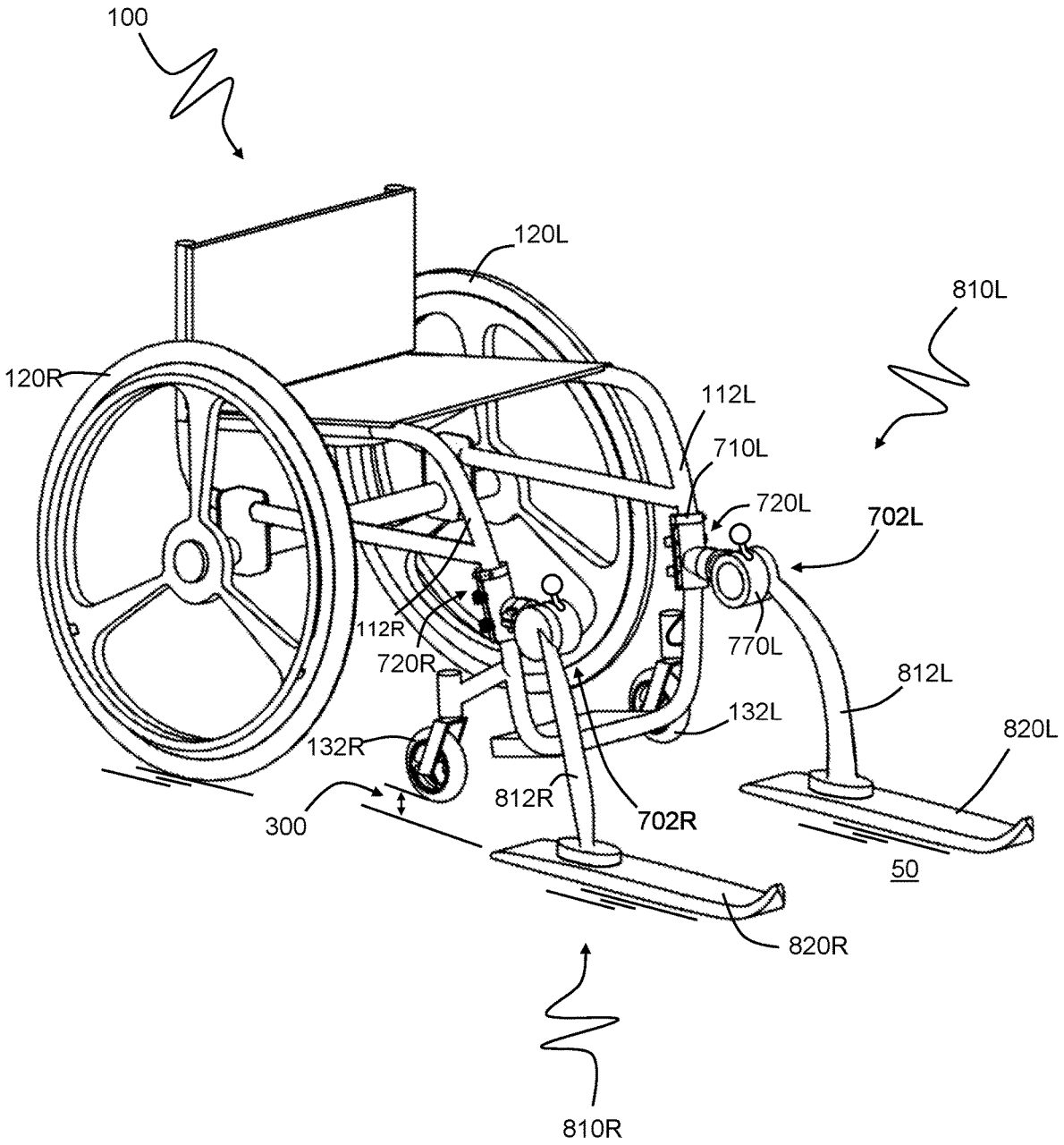

FIG. 8B shows the wheelchair 100 having dual symmetrically opposing ski assemblies 810L and 810R, each separately attached, in conjunction with respective clamps 720L and 720R and transitioning mechanism assemblies 702L and 702R, to the left and the right sides 112L and 112R of the wheelchair frame. The adaptive skis 820L and 820R are supporting the forward portion of the load carried by the wheelchair 100, with the primary caster wheels 132L and 132R of the wheelchair 100 substantially elevated above the ground surface 50 and thus fully relieved of any loading.

Figure 9A:
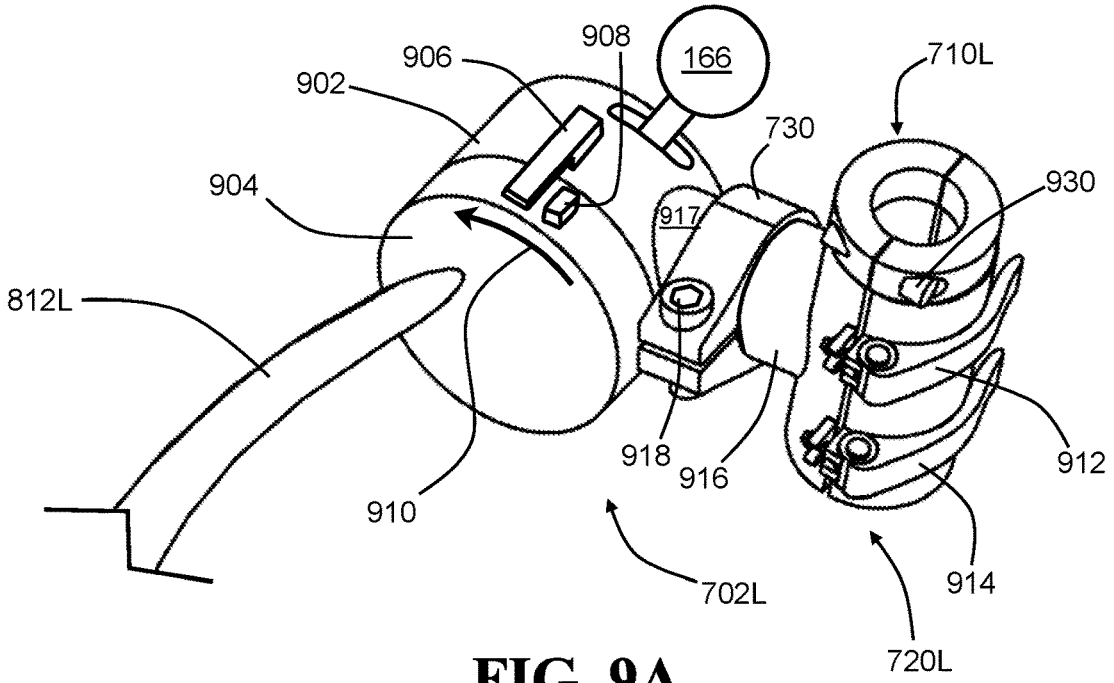
FIGS. 9A and 9B display a clamping-type adapter comprising a detent element and a detent bar which limit the range of motion of a moveable portion of the adapter.
Figure 9B:
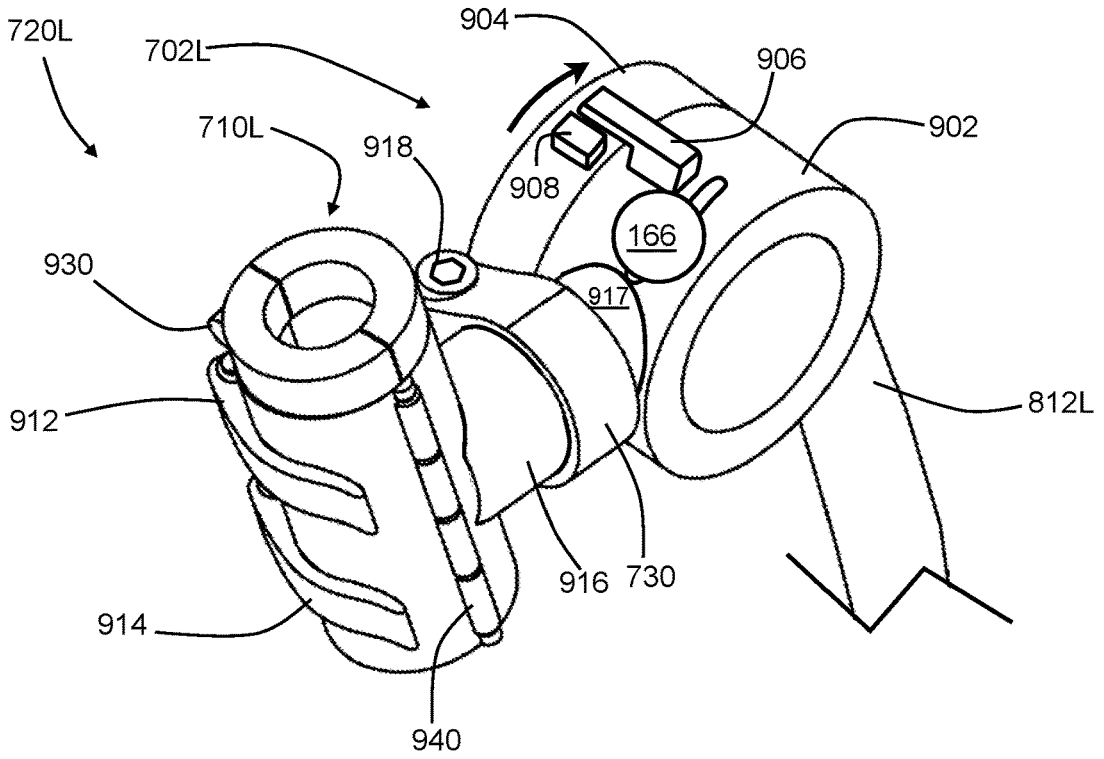

FIGS. 9A and 9B are close-up views of the detached clamping-type apparatus with left-side transitioning mechanism assembly 702L previously shown attached to the left side 112L of the wheelchair 100 in FIG. 8B. Clamp assembly 720L comprises cam-action lever fasteners 912 and 914 which enable the user to releasably secure the clamping type apparatus to the frame of the wheelchair. Disposed between rotatable member 904 and the ski implement (not shown) is support member 812L. A first cylindrical extender 916 of clamp assembly 720L is adjustably secured to a second cylindrical extender 917 of the fixed member 902 with collar 730L which is tightened with collar bolt 918. The directional arrow 910 imprinted on the rotatable member 904 in FIG. 9A indicates the direction in which the rotatable member 904, the support member 812L, and the adaptive implement (not shown) connected thereto will rotate when the apparatus is attached to the wheelchair 100 (not shown) and upon the occupant of the wheelchair performing a wheel-stand maneuver. An external detent element 908, attached externally to the rotatable member 904, limits the rotation of the rotatable member 904 in that it does not permit continued rotation of the rotatable member 904 in the direction of the imprinted arrow 910 upon the external detent element 908 contacting the external detent bar 906 attached externally to the fixed member 902. The internal state of the transitioning mechanism assembly 702L is alternated upon the user or occupant manipulating the control knob 166, operatively connected to the switch subassembly contained within the transitioning mechanism assembly 702L, between a clockwise position and a counterclockwise position.

FIGS. 10A-D are lateral views of the wheelchair 100 and the clamping-embodiment apparatus 700 illustrating the positioning thereof, with respect to the ground surface, during transitioning through the four stages of operation.

Figure 10A:
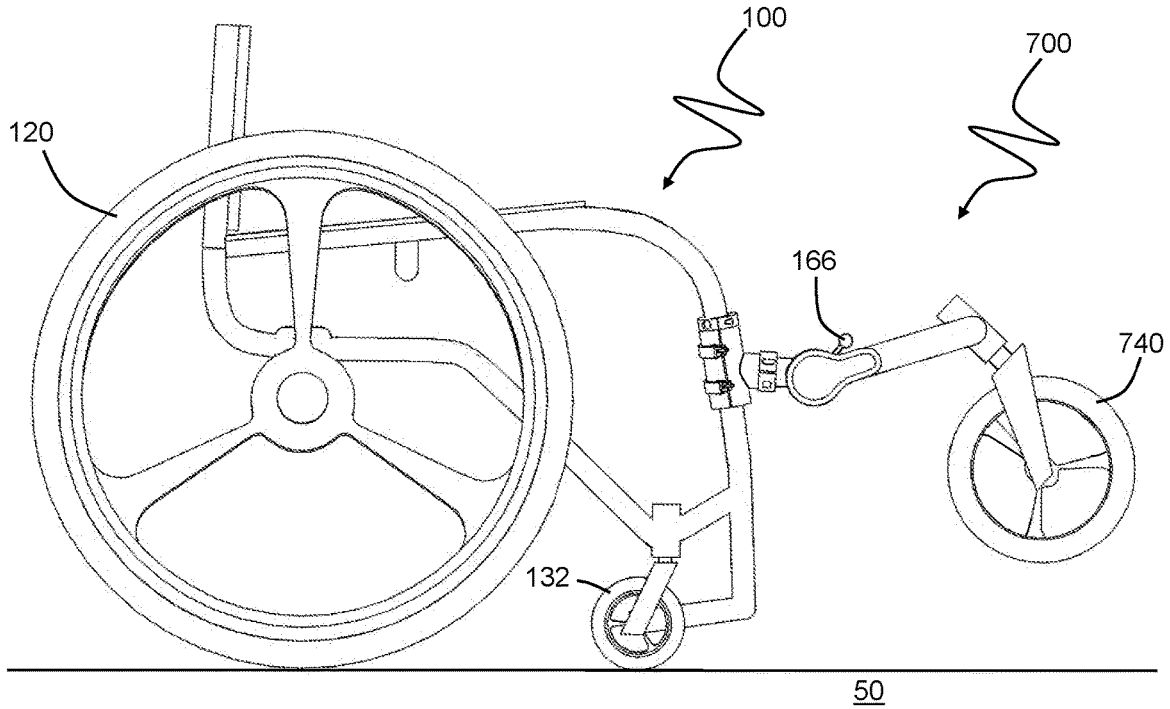
FIGS. 10A-D are side views of the wheelchair and clamping-type adapter during the four stages of the cyclic operation sequence (release/attach stage, pre-deployment stage, deployment stage, pre-release stage).

FIG. 10A shows a lateral view of the clamping-embodiment apparatus 700 secured to the wheelchair at the location defined by a positioning collar, with the control knob 166 in its most forward position so that the internal spring state is biased towards maintaining release of the binding elements from contact and thus no load transfer to the apparatus.

Figure 10B:
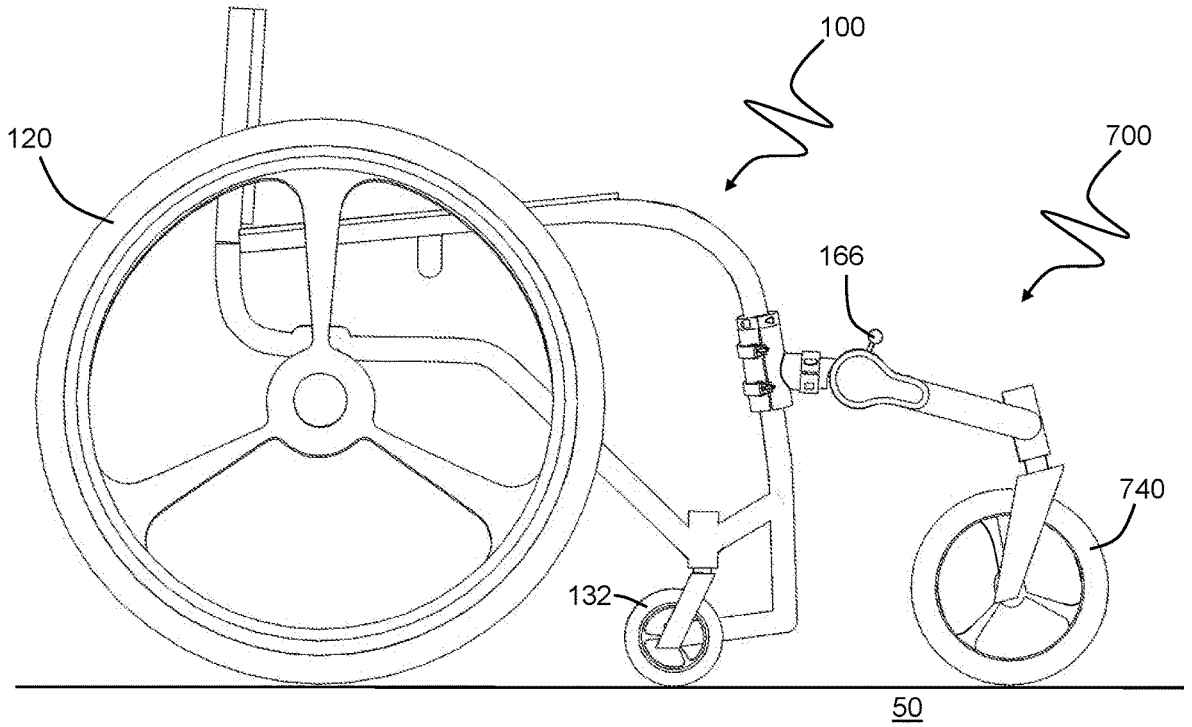

FIG. 10B shows a lateral view of the clamping-embodiment apparatus 700 with its wheel resting on the ground surface yet bearing no load and with its control knob 166 in its most rearward position so that the internal spring state is biased towards establishing contact of the binding elements; in this pre-deployment stage or condition, the mechanism is thus prepared for transition to the deployment stage of operation.

Figure 10C:
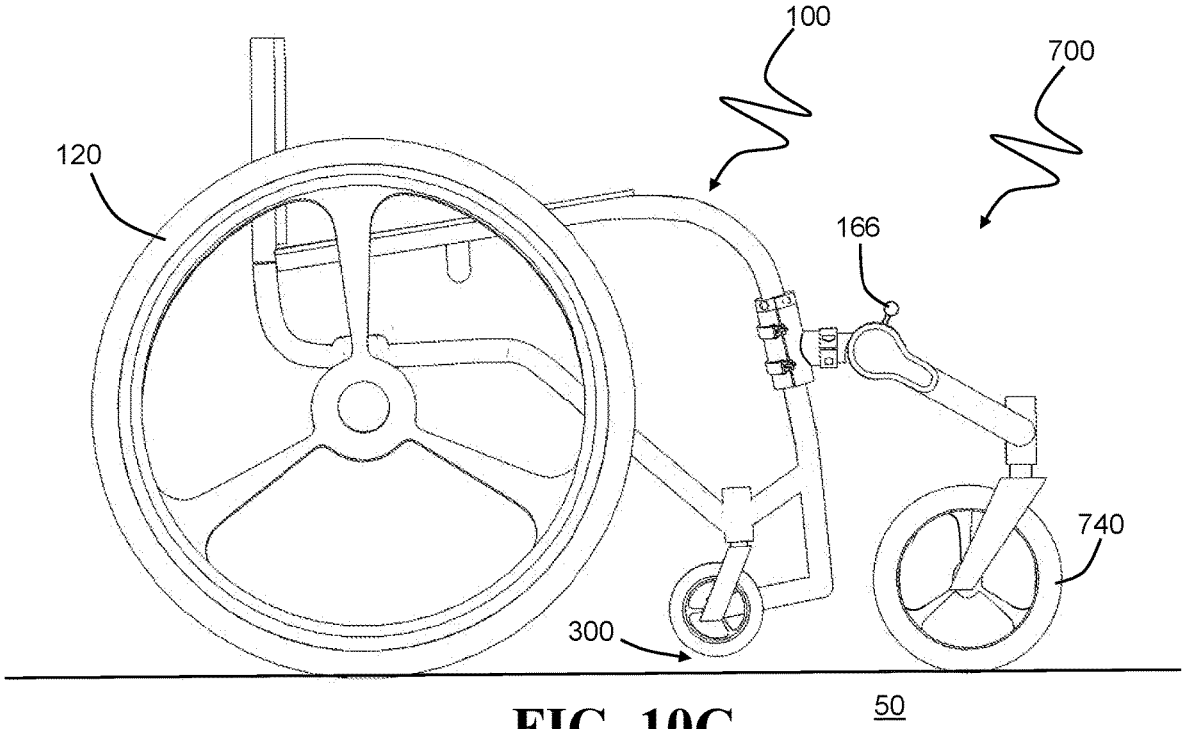

FIG. 10C shows a lateral view of the clamping-embodiment transitioning apparatus 700 in the deployment stage, during which the apparatus is deployed and load-bearing and the primary casters are substantially elevated from contact with the ground surface. The control knob 166 remains in its most rearward position until the user manipulates it with a forward push using the hand, thumb or fingers.

Figure 10D:
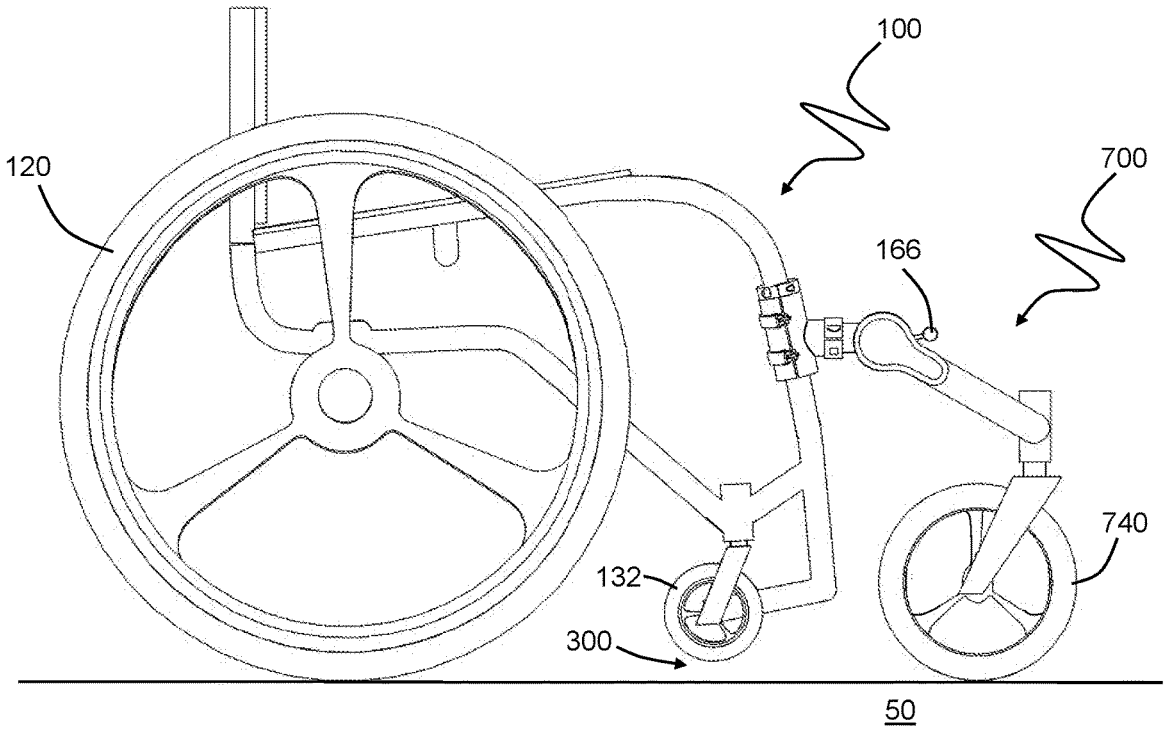

FIG. 10D shows a lateral view of the clamping-embodiment apparatus 700 in the pre-release stage, during which the apparatus is load-bearing and the primary casters are substantially elevated from contact with the ground surface, with the control knob 166 in its most forward position so that the internal spring state is biased towards releasing the binding elements from load-bearing contact. Only upon the user reclining the wheelchair substantially will such release of the binding elements occur, after which event the primary caster wheels will drop back down into contact with the ground surface.

Figure 11A:
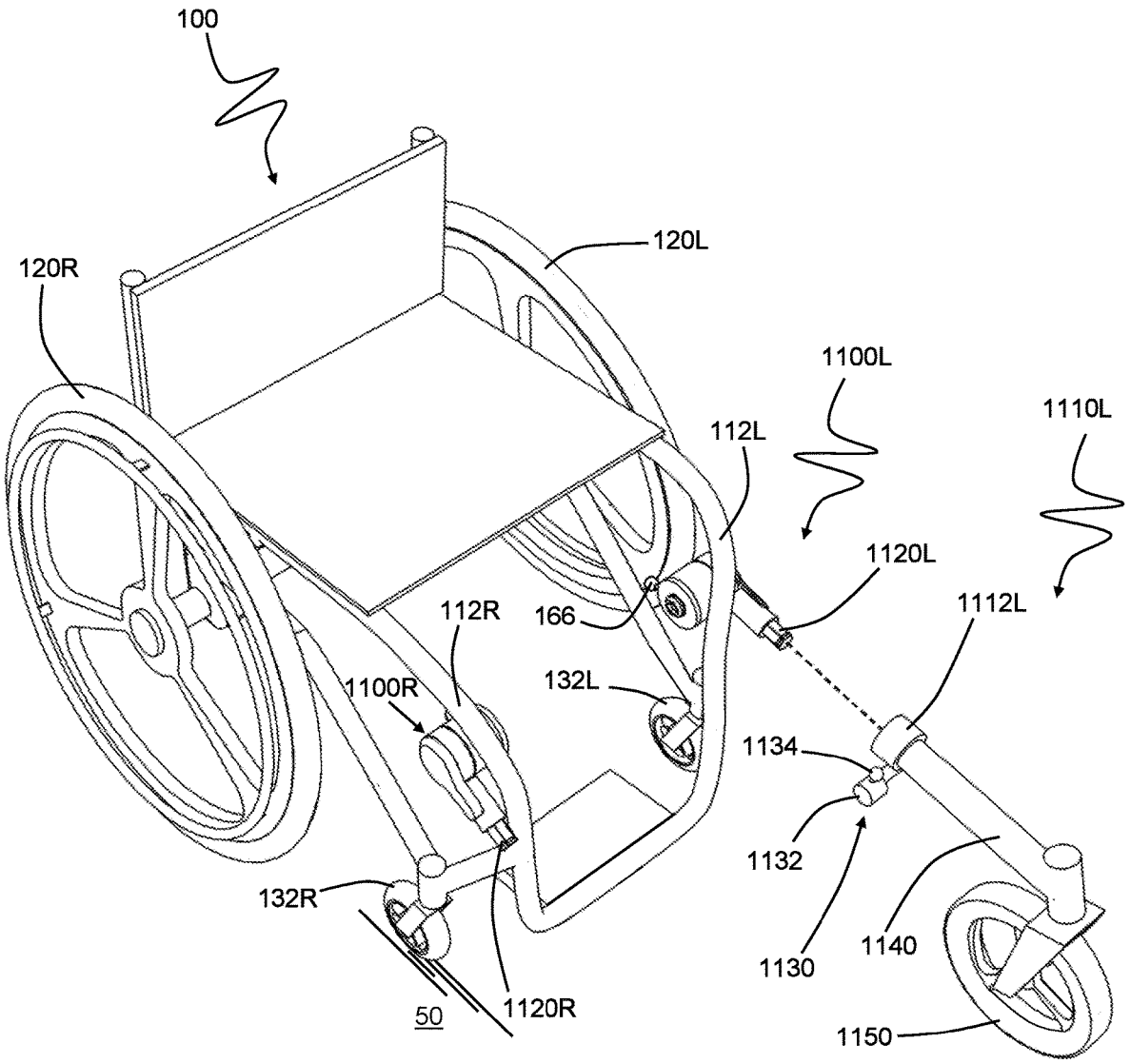
FIGS. 11A and 11B depict the attachment of and deployment of forward attaching auxiliary wheel assemblies in an alternate manner. Forward inserting transitioning mechanism assemblies affixed to the left and right sides of the frame of the wheelchair are capable of being rotated into an upward position for connection of the left and right forward attaching auxiliary wheel assemblies, followed by rotation into a downward position for deployment of the auxiliary wheel assemblies.
Figure 11B:
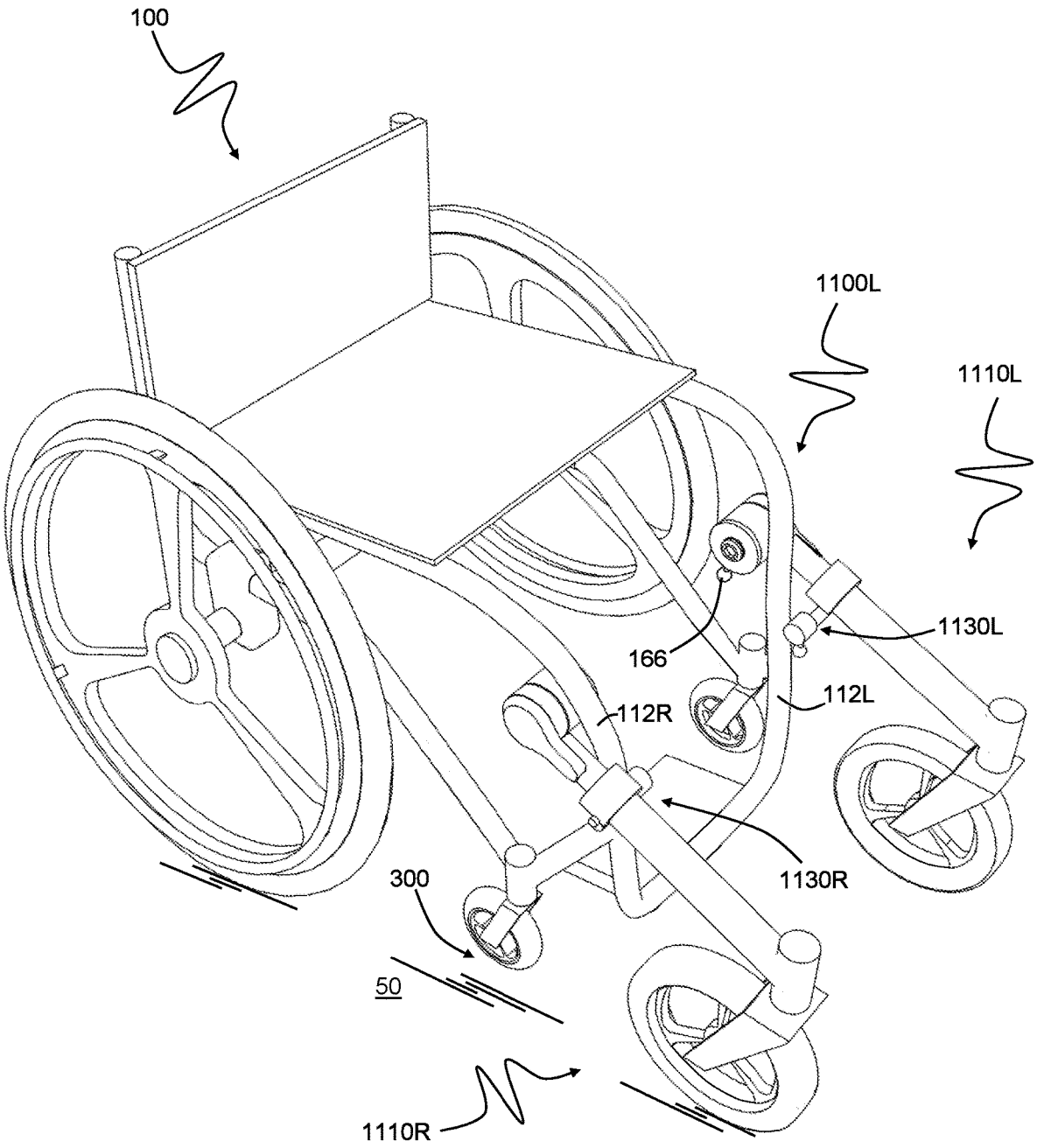

FIGS. 11A and 11B depict the attachment of and deployment of forward attaching auxiliary wheel assemblies 1110L and 1110R utilizing forward inserting mounting assemblies 1100L and 1100R secured to opposing lateral portions 112L and 112R of wheelchair 100. Dashed lines in FIG. 11A illustrate the path of longitudinal insertion which aligns forward attaching auxiliary wheel assembly 1110L with forward-inserting mounting assembly 1100L. Forward-inserting mounting assembly 1100L is shown, while in the release/attach stage, positioned at an angle in which it is fully prepared to receive or couple with the forward attaching auxiliary wheel assembly 1110L. Control switch 166 of load transitioning mechanism contained within mounting assembly 1100L, is shown in an upward position. In FIG. 11A, forward-inserting mounting assembly 1100R is shown, while in the release/attach stage, positioned at an angle in which it is not fully prepared to receive or couple with the forward attaching auxiliary wheel assembly 1110R (not shown). In FIG. 11B, control switch 166 is shown in a downward position.

A cam tensioning assembly 1130L comprising a cam body 1132 and a handle 1134 is integrated with the quick-release collar 1112L. Upon coupling the quick-release collar 1112L with the inserting member 1120L and upon subsequently deploying the auxiliary wheel assembly 1110L, as depicted in FIG. 11B, the cam tensioning assembly 1130L may be utilized to apply counter-pressure against the lateral portion 112L of the wheelchair 100. The aforementioned method is used to enhance the rigidity of the union of both auxiliary wheel assemblies 1110L and 1110L with the wheelchair 100.

Example

Dual (left and right) adaptive caster wheel apparatuses, each having a load-transitioning mechanism which separably integrates with a ground-contacting adaptive caster wheel implement, were built and configured for the purpose of lengthening the effective wheelbase of the wheelchair and also for decreasing the rolling resistance experienced by the user, especially while traversing over ground substrates such as sand, gravel, woodchips, grass, and snow.

Both apparatuses were configured to be removably and adjustably affixed to the tubular frame of a Ti-Lite TRA rigid-style ultralight titanium wheelchair by way of mounting clamps which were semi-permanently affixed onto the left and right forward lateral supports of the tubular frame of the wheelchair; each device occupies a space immediately above a primary caster wheel assembly on its respective side of the wheelchair. The load transitioning mechanism of the device remains affixed to the wheelchair at all times and is unobtrusive to the user's arms, legs, and feet, and outerwear, including while any adaptive implements are decoupled from the load transitioning device.

Both apparatuses were further configured to receive any one of a variety of adaptive implements, most notably a selection of attachable all-terrain caster wheel implements adapted for use in urban, suburban, and rural environments encountered in the State of Wisconsin.

Early prototypes of the mechanism were constructed by modifying pre-manufactured "stepless" roller clutch hand ratchets, each capable of withstanding torque in excess of 300 ft-lbs. Modifications were made to clamp the input end (the handle) of the ratchet to the tubular frame of the wheelchair, as well as to form a coupling on the output end of the ratchet in a manner which exhibits minimal wiggle or play. Also, for each device, a cylindrical aluminum outer casing was fabricated and secured, using a series of set screws, to fit tightly over and completely enclose the main body of the hand ratchet, and an aluminum cover plate was screwed onto the side opposite the side from which the output shaft of the ratchet projects.

Internally, each roller clutch ratchet has a plurality of cylindrical rollers which function as movable bearings that are selectably wedged between a hardened steel outer casing and a hardened steel inner load transfer spindle, depending on the rotary position of a control dial. The control dial was modified to receive a first arm of a torsion spring, with the opposing second arm of the torsion spring projecting out of the outer casing through an elongated passageway machined out of the outer casing. The passageway was dimensioned so as to limit the rotational travel of the second arm of the torsion spring in both directions while allowing sufficient clearance for the second arm of the torsion spring to freely travel between both ends of the passageway.

Notches at the opposing ends of the passageway receive the second arm of the torsion spring upon the user manipulably forcing the second arm therein. The torsion spring, which is maintained centrally within the cylindrical outer casing by a cylindrical nylon shaft, behaves in conjunction with the notches of the passageway as a simplistic yet effective means for biasing the control dial (and thus the cylindrical roller bearings) in either an engaging direction of rotation or a disengaging direction of rotation. When the torsion spring is disposed in the first notch of the passageway, the spring is deflected to "wind up" and, in effect, applies a sustained urging force in a forward direction to cause the control dial to rotate in the engaging direction. When the torsion spring is disposed in the second notch of the passageway, the spring is deflected to "wind down" and, in effect, applies a sustained urging force in a reverse direction to cause the control dial to rotate in the disengaging direction. When the torsion spring is disposed at a location in the passageway between the first notch and the second notch, the torsion spring is relaxed.

A spherical knob was fitted to the end of the second arm of the torsion spring to achieve a compact yet comfortable means for the user to manipulate the position of the arm. A mechanism was later devised which employs dual, opposing torsion springs which act in a similar fashion to enable the user to control the direction in which urging force is sustained throughout the operation sequence of the load transitioning mechanism.

As a system, the pair of opposing load transitioning assemblies has performed exceptionally well in conjunction with the rigid-frame wheelchair on outdoor surfaces including sand, gravel, wood chips, smooth pavement, rugged weathered pavement, city sidewalks, and snowy neighborhood streets, while enabling the user to alternate his wheelchair between a modified configuration intended for outdoor, rugged terrain and the original, unadapted configuration which is ideally suited to indoor environments.

Each apparatus was built, with load-bearing capacity in mind, for attachment to one side of the wheelchair so that it may perform safely and reliably in conjunction with, though operated independently of, the apparatus attached to the opposing side of the wheelchair.

To convert the wheelchair from its original configuration to the adapted configuration, the user first positions the left and right load transitioning devices such that their rotatable extension members are oriented upward so that a male end of each extension member is ready to couple with the end socket of the respective attachable caster wheel implement. The user secures the coupling by tensioning a quick-release collar to constrict the end socket around the male portion of the rotatable extension member.

Next, the user manually actuates the force-sustaining subassembly of each transitioning device by pushing the knob in a forward direction and securing the arm of the torsion spring into the forward notch of the passageway, and he subsequently lowers both attachable caster wheel implements until they contact the ground surface. The user effectuates the transition to the adapted configuration by reclining the wheelchair backward so that the primary caster wheels of the wheelchair are elevated and maintained approximately 1½ inches above the ground surface. The user then further secures the adapting member to the mounting member by rotating a cam-action tensioning assembly, attached to the extension arm of each caster wheel implement, in a downward direction so that it compresses firmly against the forward frame tube of the wheelchair. The caster wheels remain elevated above the ground surface during travel in all directions and do not add rolling resistance or otherwise interfere with the performance of the wheelchair in its adapted mode, as the large forward caster wheel now bears the load distributed towards the front of the wheelchair.

To remove the attachable caster wheel implements from the wheelchair—that is, to convert the wheelchair from the adapted configuration back to the original configuration—the user rotates the cam-action tensioning assembly on each caster wheel implement in an upward direction so that it decompresses against the forward frame tube of the wheelchair. The user then manually actuates the force-sustaining subassembly of each transitioning device by removing the knob and spring arm from the forward notch of the passageway and disposing the knob and spring arm in the opposing, rearward notch; at this time the load transitioning device will continue to bear the load distributed toward the front of the wheelchair. Upon the user reclining the wheelchair backward so that the primary caster wheels of the wheelchair are elevated slightly, the user effectuates the transition to the original configuration, with the primary caster wheels of the wheelchair instantly lowered down into contact with the ground surface as the user brings the wheelchair into its upright, unreclined position. The user is then able to lift both caster wheel implements upward, release constricting tension on the quick-release collars, and subsequently detach both caster wheel implements from the rotatable extension members of their respective load transitioning devices.

Having the load transitioning device affixed to the wheelchair and ready to receive the attachable caster wheel implement, the user has benefited from improved versatility. As needed, the user quickly outfits the wheelchair with dual caster assemblies that are substantially larger and more robust than the original primary caster assemblies that are permanently integrated with the wheelchair, and includes a 50 mm wide, 8-inch diameter pneumatic tire fitted over an aluminum wheel hub. This tire was chosen because, when inflated, it exhibits excellent rolling resistance on both rugged surfaces and smooth surfaces alike, and provides sufficient grip against paved surfaces to help prevent flutter of the caster assembly when approaching vehicle speeds of around 8 MPH or 12 KmPH, which is about average human running speed. Other wheel arrangements have been used, including: a 75 mm wide, 8-inch diameter pneumatic tire fitted over an aluminum wheel hub; and a 35 mm wide, 6-inch diameter soft-roll solid caster having an aluminum hub and connected to a shock-absorbing suspension caster assembly.

The user, having a complete spinal cord injury at the level of the sixth thoracic vertebra, has no motor or sensory function in his legs and in the lower half of his torso, and has benefited from the smoother riding characteristics and the added forward stability that result from attachment of the apparatus to his wheelchair. With the adaptive caster wheels deployed, the user has avoided being forwardly tumbled or ejected from the seated position and has furthermore been able to allocate more time towards enjoying and viewing the surrounding landscape while propelling the wheelchair forward, such as around his neighborhood and at a nearby state park, with less time directed towards observing and avoiding the small bumps, cracks, tree roots, and other obstacles that would otherwise put him at significant risk of falling out of his wheelchair.

REMARKS

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

When introducing elements of aspects of the invention or the embodiments thereof, the articles "a," "an," "the," and "said" are intended to mean that there are one or more of the elements. The terms "comprising," "including," and "having" are intended to be inclusive and mean that there may be additional elements other than the listed elements.

Having described aspects of the invention in detail, it will be apparent that modifications and variations are possible without departing from the scope of aspects of the invention as defined in the appended claims. As various changes could be made in the above compositions, products, and methods without departing from the scope of aspects of the invention, it is intended that all matter contained in the above description shall be interpreted as illustrative and not in a limiting sense. Reference to particular illustrative embodiments should not be construed as limitations. The inventive devices, products, and methods can be adapted for other uses or provided in other forms not explicitly listed above, and can be modified in numerous ways within the spirit of the present disclosure. Thus, the present invention is not limited to the disclosed embodiments.

I claim:

1. A wheelchair reconfiguration system capable of reversibly deploying a first auxiliary wheel assembly in a predetermined angular orientation relative to a wheelchair, the wheelchair comprising a frame, the frame having left and right opposing lateral portions, the wheelchair further comprising a pair of symmetrically-opposing rear wheels and a pair of symmetrically-opposing front caster wheels for supporting a forward portion of a load carried by the wheelchair while the wheelchair is in an original load-bearing configuration, the wheelchair reconfiguration system comprising:

a) the first auxiliary wheel assembly, capable of supporting the forward portion of the load carried by the wheelchair;

b) a first mounting assembly for securing the first auxiliary wheel assembly relative to one of the left and the right opposing lateral portions of the frame of the wheelchair in a forward location relative to the frame of the wheelchair;

c) a first cam tensioning assembly comprising a handle and a cam body, the first cam tensioning assembly being capable of: 1.) defining a rotational endpoint, in a first direction of rotation, of the first auxiliary wheel assembly relative to the frame of the wheelchair during deployment of the first auxiliary wheel assembly in the predetermined angular orientation relative to the wheelchair, and 2.) inhibiting relative movement between the first auxiliary wheel assembly and the frame of the wheelchair during deployment of the first auxiliary wheel assembly in the predetermined angular orientation relative to the wheelchair.

2. The wheelchair reconfiguration system of claim 1, the first mounting assembly comprising a load transitioning mechanism.

3. The wheelchair reconfiguration system of claim 2, the load transitioning mechanism comprising a control switch, the control switch capable of switchably preparing the load transitioning mechanism for alternating the wheelchair between the original load-bearing configuration and a modified load-bearing configuration, the load transitioning mechanism being capable of maintaining the first auxiliary wheel assembly in the predetermined angular orientation relative to the wheelchair while the wheelchair is in the modified load-bearing configuration.

4. The wheelchair reconfiguration system of claim 1, the first cam tensioning assembly being configured to selectably assume a first orientation which substantially inhibits relative movement between the first auxiliary wheel assembly and the wheelchair during deployment of the first auxiliary wheel assembly in the predetermined angular orientation relative to the wheelchair, the first cam tensioning assembly being further configured to selectably assume a second orientation which substantially permits relative movement between the first auxiliary wheel assembly and the wheelchair.

5. The wheelchair reconfiguration system of claim 1, the first cam tensioning assembly being configured to selectably engage with the frame of the wheelchair wherein engagement of the first cam tensioning assembly with the frame of the wheelchair substantially inhibits relative movement in the first direction of rotation between the first auxiliary wheel assembly and the frame of the wheelchair during deployment, and wherein disengagement of the first cam tensioning assembly from the frame of the wheelchair substantially permits relative movement in the first direction of rotation between the first auxiliary wheel assembly and the frame of the wheelchair.

6. The wheelchair reconfiguration system of claim 1, wherein deployment of the first auxiliary wheel assembly is effectuated simultaneously with deployment of a second auxiliary wheel assembly, and wherein disengagement of the first auxiliary wheel assembly is effectuated simultaneously with disengagement of the second auxiliary wheel assembly.

7. A wheelchair reconfiguration system capable of deploying a pair of auxiliary wheel assemblies in a predetermined angular orientation relative to a wheelchair, the wheelchair comprising a frame, the frame having left and right opposing lateral portions, the wheelchair further comprising a pair of symmetrically-opposing rear wheels and a pair of symmetrically-opposing front caster wheels for supporting a forward portion of a load carried by the wheelchair while the wheelchair is in an original load-bearing configuration, the wheelchair reconfiguration system comprising:

a) the pair of auxiliary wheel assemblies, capable of supporting the forward portion of the load carried by the wheelchair;

b) a pair of mounting assemblies, adapted to couple with the pair of auxiliary wheel assemblies for securing to the left and the right opposing lateral portions of the frame of the wheelchair in a forward location relative to the frame of the wheelchair, and c) a pair of tensioning assemblies, each comprising a handle and a rotatable body, each one of the tensioning assemblies being capable of: 1.) defining a rotational endpoint, in a first direction of rotation, of one of the pair of auxiliary wheel assemblies relative to the frame of the wheelchair during deployment of the pair of auxiliary wheel assemblies in the predetermined angular orientation relative to the wheelchair, and 2.) inhibiting relative movement between one of the pair of auxiliary wheel assemblies and the frame of the wheelchair during deployment of the pair of auxiliary wheel assemblies in the predetermined angular orientation relative to the wheelchair.

8. The wheelchair reconfiguration system of claim 7, each one of the pair of tensioning assemblies being capable of cam action for applying counter-pressure, wherein union of each one of the pair of auxiliary wheel assemblies with the wheelchair becomes substantially rigidized.

9. The wheelchair reconfiguration system of claim 7, each one of the pair of mounting assemblies comprising a load transitioning mechanism, each load transitioning mechanism being capable of maintaining one of the pair of auxiliary wheel assemblies in the predetermined angular orientation relative to the wheelchair while the wheelchair is in the modified load-bearing configuration.

10. The wheelchair reconfiguration system of claim 9, each load transitioning mechanism comprising a control switch, the control switch being capable of switchably preparing the load transitioning mechanism for alternating the wheelchair between the original load-bearing configuration and a modified load-bearing configuration, each load transitioning mechanism being capable of maintaining one of the pair of auxiliary wheel assemblies in the predetermined angular orientation relative to the wheelchair while the wheelchair is in the modified load-bearing configuration.

11. A wheelchair reconfiguration system for securing a first auxiliary wheel assembly in a predetermined position relative to a wheelchair, the wheelchair comprising a frame, the frame having left and right opposing lateral portions, the wheelchair further comprising a pair of symmetrically-opposing rear wheels, the wheelchair further comprising a pair of symmetrically-opposing front caster wheels for supporting a forward portion of a load carried by the wheelchair while the wheelchair is maintained in an original load-bearing configuration, the wheelchair reconfiguration system comprising a mounting assembly capable of connecting the first auxiliary wheel assembly to a first one of the left and right opposing lateral portions of the frame of the wheelchair, the wheelchair reconfiguration system further comprising a first tensioning assembly comprising a first rotatable body, the first rotatable body capable of defining a first rotational endpoint of the first auxiliary wheel assembly in a downward direction of rotation, the first rotatable body being capable of rotation relative to the first auxiliary wheel assembly to assume a first orientation, wherein, having the first auxiliary wheel assembly deployed in the predetermined position relative to the wheelchair and rotating the first rotatable body towards the first orientation, relative movement between the first auxiliary wheel assembly and the wheelchair is inhibited.

12. The wheelchair reconfiguration system of claim 11, the mounting assembly comprising a load transitioning mechanism, the load transitioning mechanism comprising a control switch capable of being toggled to switchably prepare the wheelchair for transitioning between the original load-bearing configuration and a modified load-bearing configuration.

13. The wheelchair reconfiguration system of claim 11, the first rotatable body being further capable of rotation relative to the first auxiliary wheel assembly to assume a second orientation, wherein, having the first auxiliary wheel assembly deployed in the predetermined position relative to the wheelchair and rotating the first rotatable body towards the second orientation, relative movement between the first auxiliary wheel assembly and the wheelchair is permitted.

14. The wheelchair reconfiguration system of claim 11, the first rotatable body being capable of cam action to enable selectable tensioning upon deploying the first auxiliary wheel assembly to secure the first rotatable body in the first orientation.

15. The wheelchair reconfiguration system of claim 11, further comprising a first handle unified with the first rotatable body, the first handle being adapted to facilitate rotation of the first rotatable body.

16. The wheelchair reconfiguration system of claim 11, the first rotatable body being capable of selectable engagement with the frame of the wheelchair.

17. The wheelchair reconfiguration system of claim 11, further comprising a second tensioning assembly comprising a second rotatable body, the second rotatable body capable of defining a second rotational endpoint of a second auxiliary wheel assembly in the downward direction of rotation, the second rotatable body being further capable of rotation relative to the second auxiliary wheel assembly.

18. The wheelchair reconfiguration system of claim 17, the second rotational endpoint of the second auxiliary wheel assembly being substantially the same as the first rotational endpoint of the first auxiliary wheel assembly.

19. The wheelchair reconfiguration system of claim 11 comprising at least one adaptive implement.

* * * * *